US007387824B2

(12) United States Patent
Tamagawa et al.

(10) Patent No.: US 7,387,824 B2
(45) Date of Patent: Jun. 17, 2008

(54) SUPPORT FOR IMAGE RECORDING MEDIUM AND IMAGE RECORDING MEDIUM MADE FROM THE SUPPORT

(75) Inventors: Shigehisa Tamagawa, Shizuoka (JP); Hiroshi Yamamoto, Shizuoka (JP); Shinichi Teramae, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 61 days.

(21) Appl. No.: 11/215,995

(22) Filed: Sep. 1, 2005

(65) Prior Publication Data

US 2006/0051532 A1 Mar. 9, 2006

(30) Foreign Application Priority Data

Sep. 1, 2004 (JP) ..... 2004-254909

(51) Int. Cl.
*B41M 5/40* (2006.01)

(52) U.S. Cl. ..... 428/32.63; 428/32.21; 428/32.24; 428/32.39; 428/211.1; 428/537.5; 427/121; 430/31; 430/227; 430/230; 503/200; 503/227

(58) Field of Classification Search ..... 428/32.21, 428/32.24, 32.39, 32.63, 211.1, 537.5; 427/121; 430/31, 227, 230; 503/200, 227
See application file for complete search history.

(56) References Cited

U.S. PATENT DOCUMENTS 4,433,030 A * 2/1984 Tamagawa et al. ..... 428/47.6
4,659,430 A * 4/1987 Tamagawa et al. ..... 162/135
4,678,742 A * 7/1987 Tamagawa et al. ..... 430/523
6,406,796 B1 * 6/2002 Ohmura et al. ..... 428/511
2003/0083200 A1 * 5/2003 Serizawa et al. ..... 503/226
2003/0198885 A1 * 10/2003 Tamagawa et al. ..... 430/124
2003/0235683 A1 * 12/2003 Tamagawa et el. ..... 428/195.1

FOREIGN PATENT DOCUMENTS

JP 7-70984 3/1995
JP 8-269897 10/1996
JP 11-81190 3/1999

* cited by examiner

*Primary Examiner*—Callie Shosho
*Assistant Examiner*—David J Joy
(74) *Attorney, Agent, or Firm*—Young & Thompson

(57) ABSTRACT

A support for an image recording medium includes base paper, a polymer coating layer formed on both top and wire side surfaces, and a coating layer containing a pigment and an adhesive agent which is formed under the polymer coating layer on one or both side surfaces. The support has a water absorbence less than 20 mg in terms of cross section water absorption quantity given by the following expression: Cross section water absorption quantity (mg)=A−B where A is the mass of a 10×1.5 cm support after wiping off attached water after five minute immersion in a water bath at 20° C. and B is the mass of the paper base support before immersion.

8 Claims, 2 Drawing Sheets

SUPPORT FOR IMAGE RECORDING MEDIUM AND IMAGE RECORDING MEDIUM MADE FROM THE SUPPORT

BACKGROUND OF THE INVENTION

1. Field of the Invention

The present invention relates to a support suitable for an image recording medium which has a surface and trimmed edges superior in water resisting property and which is capable of providing high gloss and high quality images thereon and an image recording medium made from the support.

2. Description of Related Art

Typically, a support for an image recording medium used in electrophotographic recording, heat sensitive recording, ink-jet recording, sublimation transfer recording, silver halide photographic recording, thermal development recording, etc. comprises, for example, a base paper, artificial or synthetic, a synthetic resin paper, a coated paper, a laminated paper, etc. The recent development of technology enables the image recording medium used in electrophotographic recording or ink-jet recording to provide prints of equivalent image quality with silver salt photographic prints readily.

In the case where an image recording medium is used as printing paper for posters or leaflets intended for an outdoor display or a display in water related surroundings, the image recording medium is required to have water resisting property. It is also required for the image recording medium to be resistant to water in order to prevent irreplaceable prints from casual or accidental water damages during a long-term storage. For good water resistant, it is essential for the image recording medium to have not only an enhanced water resisting surface for image formation but also enhanced water resisting cut edges.

There have been proposed in, for example, Unexamined Japanese Patent Publication Nos. 7-70984, 8-269897 and 11-81190 water resistant image recording media that are made from a support comprising base paper with high water resistant polymer coating layers on a top side (a side for image formation) and a wire side surface thereof or a support comprising base paper with a coating layer containing a water resisting additive or a water repellent additive on a top side surface.

Such the image recording media are not originally aimed at improvement of water resisting properties and, therefore, have only poor water resistance especially at cut edges and are not suitable for high quality prints.

SUMMARY OF THE INVENTION

It is therefore an object of the present invention to provide a support for an image recording medium which has a surface and trimmed edges superior in water resisting properties and high surface smoothness and which is capable of providing high gloss and high quality images thereon.

It is another object of the present invention to provide an image recording medium comprising the paper base support that is capable of providing high quality print images thereon.

The foregoing objects of the present invention are achieved by a paper base support for an image recording medium comprising base paper, a polymer coating layer formed on each of a top and a wire side surfaces of the base paper, and a coating layer containing a pigment and an adhesive agent which is formed under the polymer coating layer on at least one of the top and wire side surfaces of the base paper. The paper base support should have a water absorbence less than 20 mg in terms of water absorption quantity of cross section given by the following expression $$\text{Water absorption quantity of cross section (mg)}=A-B$$

where A is the mass of a 10×1.5 cm paper base support after wiping off attached water after five minute immersion in a water bath at 20° C. and B is the mass of the paper base support before immersion.

The paper base may contain a sizing agent, preferably selected from a group consisting of alkylketene dimers, epoxidized fatty acid amide, alkenyl anhydrate succinic acids and higher fatty acid salts, grater than 0.1% in mass content. The coating layer may comprise a cast coating layer and contain at least one of a water resisting additive and a water repellent additive. Further, the polymer coating layer may contain a polyolefin resin.

An image recording medium comprises the paper base support and an image recording layer formed on the paper base support.

The image recording medium is suitably used for one selected from a group of an electrophotographic image recording medium, a heat sensitive recording medium, a sublimation transfer recording medium, a thermal transfer recording medium, a silver halide photographic recording medium and an ink-jet recording medium.

BRIEF DESCRIPTION OF THE DRAWINGS

The foregoing and other objects and features of the present invention will be clearly understood from the following detailed description when read with reference to the accompanying drawing, in which.

DETAILED DESCRIPTION OF THE PREFERRED EMBODIMENTS

Figure 1:
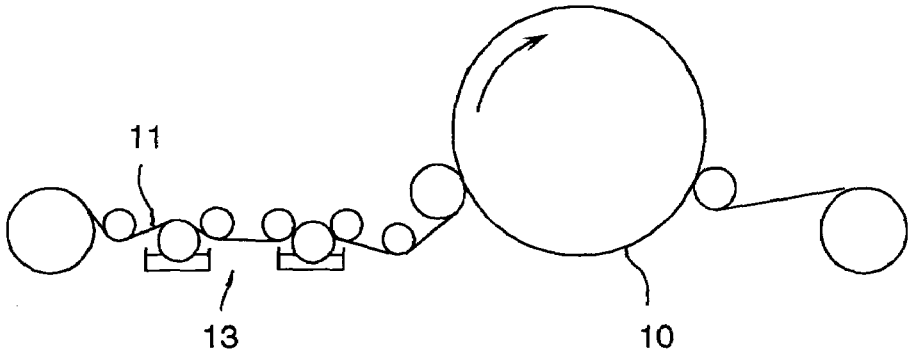
FIG. 1 is a schematic view illustrating an example of a wet-cast process.

A paper base support of the present invention for use in making an image recording medium or paper comprises a base paper, a polymer coating layer formed on each surface of the base paper, and a coating layer containing a pigment and an adhesive agent which may be formed between the polymer coating layer at each or both top and wire sides of the base paper. The paper base support may comprise other layers as appropriate. The paper base support should have a water absorbence preferably less than 20 mg, more preferably less than 17 mg and most preferably in a range of from 2 to 15 mg in terms of water absorption quantity of cross section given by the following expression.

$$\text{Water absorption quantity of cross section (mg)}=A-B$$

where A is the mass of a 10×1.5 cm paper base support after wiping off attached water immediately after five minute immersion in a water bath at 20° C. and B is the mass of the paper base support before the immersion.

The paper base support possibly encounters an occurrence of edge undulations and/or edge blisters and causes edges to be conspicuously splotched with a colored penetrating liquid if having water absorbence greater than 20 mg in terms of water absorption quantity of cross section.

Further, the paper base support should have a degree of sizing preferably in a range of from 5 to 35 g/m$^2$ and more preferably in a range of from 6 to 31 g/m$^2$, in Cobb$_{120}$ value measured by the method meeting JIS P8140 (Paper and board—Determination of water absorptiveness—Cobb method). The paper base support possibly encounters loose adhesion of the coating layer to the base paper due to insufficient penetration of the coating liquid into the base paper if having a degree of sizing less than 5 g/cm$^2$ in Cobb$_{120}$ value and, on the other hand, cause aggravation of surface roughness of the base paper when applying the coating liquid to the base paper if having a degree of sizing greater than 35 g/cm$^2$ in Cobb$_{120}$ value.

The base paper is not bounded by types and may be adopted from various papers according to purposes. Specific examples available as the base paper include papers listed in "Fundamentals of Photographic Engineering—Silver Salt Photography—" at pages from 223 to 224, edited by Japanese Society of Photograph (1979, Corona Co., Ltd.).

In order to impart desired center line mean surface roughness to the base paper, it is preferred to use pulp fibers having such a distribution of fiber length as disclosed in, for example, Unexamined Japanese Patent Publication No. 58 (1983)-68037 (e.g. pulp fibers comprising fibers 20 to 45% by mass in total residual volume after screening with 24-mesh and 42-mesh screens and residual fibers less than 5% by mass in residual volume after screening with a 24-mesh screen). The base paper can be adjusted in surface roughness by application of heat and pressure through a machine calender or a super calendar.

The base paper is not bounded by pulp materials and may be made from appropriate materials well known as suitably available for paper base supports. Examples of the pulp materials for the base paper include natural pulp such as coniferous tree pulp or broad leaf tree pulp and mixtures of these natural pulp and synthetic pulp. While it is preferred to use the broad leaf tree kraft pulp (LBKP) from the viewpoint of improving surface smoothness, stiffness and dimensional stability (curling) of the base paper well-balanced all together and built up to a sufficient level, it is allowed to use the coniferous tree kraft pulp (NBKP) or broad leaf tree sulfite pulp (LBSP).

The pulp can be beaten to a pulp slurry (which is referred to as pulp stock) by the use of, for example, a beater or a refiner. It is preferred for the base paper to have a freeness in a range of from 200 to 440 ml in Canadian Standard Freeness (C.S.F.) and more preferably in a range of 200 to 440 ml in C.S.F. from the viewpoint of controlling shrinkage in a paper machining process.

It is allowed to add various additives, e.g. fillers, dry paper strength agents, sizing agents, wet paper strength agents, fixing agents, pH adjusters and other chemical conditioners, to the pulp slurry as appropriate.

Examples of the sizing agents include higher fatty acid salts, rosin, rosin derivatives such as maleic rosin, paraffin wax, alkylketene dimers, alkenyl anhydrate succinic acids (ASA), compounds containing high fatty acids such as epoxidized fatty acid amide, etc. The sizing agent content of the pulp stock is preferably greater than 0.1% by mass and more preferably in a range of from 0.2 to 1.0% by mass. The paper base support possibly encounters aggravation of water resistance due to an increase in water absorbence if exceeding the lower limit of 0.1% by mass.

Examples of the fillers include calcium carbonate, clay, kaolin, white earths, talc, titanium oxides, diatom earths, barium sulfate, aluminum hydroxides, magnesium hydroxides, etc.

Examples of the dry paper strength agents include cationic starch, cationic polyacrylamide, anionic polyacrylamide, ampholytic polyacrylamide, carboxy-modified polyvinyl alcohol, etc. Examples of the wet paper strength agents include polyamine polyamide epichlorohydrin, melamine resins, urea resins, epoxidized polyamide resins, etc.

Examples of the fixing agents include polyvalent metal salts such as aluminum sulfate or aluminum chloride, cationic polymers such as cationic starch, etc. Examples of the pH adjusters include caustic soda, sodium carbonate, etc.

Examples of the other chemical conditioners include deforming agents, dyes, slime controlling agents, fluorescent whitening agents, etc. In addition, it is allowed to add softening agents such as described in "New Handbook of Paper Processing" (1980, Paper Chemicals Times), pages 554 and 555 as appropriate.

These additives may be selectively added individually or in any combination of two or more. The pulp slurry is not bounded by additive content and may have an additive content in a range of from 0.1 to 1.0% by mass.

A base paper is made from a pulp stock containing the additives as appropriate by the use of a hand paper machine, a fourdrinier paper machine, a cylinder paper machine, a twin wire paper machine, a combination paper machine, etc and then dried. If desired, it is allowed to apply surface sizing to the base paper, before or after the drying. Processing liquids for the surface sizing are not bounded by compositions and may contain, for example, water-soluble high polymer compounds, water resisting agents, pigments, dyes, fluorescent whitening agents, etc. Examples of the water-soluble high polymer compounds include cationic starches, oxidized starches, polyvinyl alcohols, carboxy-modified polyvinyl alcohols, crboxymethyl cellulose, hydroxyethyl cellulose, cellulose sulfate, gelatin, casein, sodium polyacrylate, sodium salts of styrene-maleic anhydrate copolymers, polystyrene sulphonate sodium, etc. Examples of the water resisting agents include latex emulsions of styrene-butadiene copolymers, ethylene-vinyl acetate copolymers, polyethylene or vinylidene chloride copolymers, polyamide polyamine epichlorohydrin, synthetic latex, etc. Examples of the pigments include calcium carbonate, clay, kaolin, talc, barium sulfate, titanium oxides, etc.

It is preferred for the base paper to have a Young's modulus ratio of longitudinal Young's modulus (Ea) to transverse Young's modulus (Eb) in a range of from 1.5 to 2.0 in light of improving stiffness and dimensional stability (curling characteristic). The paper base support for the image recording paper is apt to encounter a deterioration in stiffness and/or dimensional stability, resulting in unfavorable deterioration in conveying or transport quality of the, if exceeding the upper or the lower limit.

It has been known that "elasticity" of paper generally varies depending upon types of beating. Elastic force or an elasticity modulus that paper made after beating attains can be used as a key factor for defining the degree of "elasticity" of the paper. In particular, since a dynamic elasticity modulus of paper that represents a solid state property of viscoelastic material that the paper bears is closely related to paper density, the elasticity modulus of paper is expressed in terms of an acoustic velocity through the paper that is measured by the use of an ultrasonic transducer Specifically, the elasticity modulus of paper is given by the following expression:

$$E=\rho c^2(1-n)$$

where E is the dynamic elasticity modulus;

ρ is the paper density, c is the acoustic velocity through paper n is the Poisson's ratio.

Because the Poisson's ratio of ordinary paper is approximately 0.2, the dynamic elasticity modulus can be approximated by the following expression:

$$E=\rho c^2$$

That is, the elasticity modulus of paper is easily obtained by substituting paper density and an acoustic velocity of paper for p and c in the above expression, respectively. An acoustic velocity of paper can be measured on various instruments well known in the art such as, for example, Sonic Tester, Model SST-110 (Nomura Co., Ltd.).

The base paper is not bounded by thickness and may have a thickness ordinarily preferably in a range of from 30 to 500 μm, more preferably in a range of from 50 to 300 μm, and most preferably in a range of from 100 to 250 μm. The base paper is not bounded by basic weight and may have a basic weight preferably in a range of from 50 to 250 g/m$^2$ and more preferably in a range of from 100 to 200 g/m$^2$.

It is preferred to calender the base paper preferably by bringing a metal roll into contact with an image side surface of the base paper. It is preferred to maintain the metal roll at a surface temperature higher than 100° C., more preferably higher than 150° C. and most preferably higher than 200° C. The surface temperature of the metal roll is not bounded by an upper limit but preferred to be approximately 300° C. The calendering is not bounded by nip pressure and may be performed preferably at a nip pressure higher than 100 kN/cm$^2$ and more preferably in a range of from 100 to 600 kN/cm$^2$.

Calenders are not bounded by types and may be of a type having a soft calender roll that comprises a combination of a metal roll and a plastic roll or having a machine calender roll that comprises a pair of metal rolls. Among them, it is preferred to employ the calender of the type having a machine calender roll, and especially preferred a long nip type of shoe calender that comprises a metal roll and a shoe roll in contact with the metal roller through a plastic belt for the reason that a long nip can be provided so as to increase a contact area between the cast coating layer and the metal roll.

The coating layer, that is formed between the base paper and the polymer coating layer, contains a pigment and an adhesive agent and may further contain a water repellent agent, a water resisting agent, and other constituent additives as appropriate. The coating layer is not bounded by form and may be in the form of cast coating layer. The cast coating layer may be formed on one side or on both sides and may have a single layer structure or a multi-layer structure.

The pigments are not bounded by types. Examples of the pigments include silica, alumina, calcium carbonates, magnesium carbonates, barium sulfate, aluminum hydroxides, kaolin, talc, clay, titanium dioxides, zinc oxides, plastic pigments, etc. These pigments may be selectively used individually or in any combination of two or more.

The adhesive agents are not bounded by types. Examples of the adhesive agents include starches such as oxidized starches, esterified starches, etc.; cellulosic derivatives such as carboxymethyl cellulose, hydroxyethyl cellulose, etc.; protein such as gelatin, casein, soy proteins, etc.; resins such as polyvinyl alcohol, polyvinyl pyrrolidone, acrylic resins, stylene-acrylic resins, vinyl acetate resins, vinyl chloride resins, urea resins, urethane resins, alkyd resins, polyester resins, polycarbonate resins; styrene-butadiene latex; and derivatives of them. These adhesive agents may be selectively used individually or in any combination of two or more. In the case where two or more adhesive agents are used, the combination may be varied according to properties, prescription and applications of the coating liquid. It is preferred for the coating layer to contain an adhesive agent or adhesive agents in a range of from 1 to 10% by mass and more preferably in a range of from 3 to 8% by mass, in solid proportion with respect to its total mass.

The coating layer is not bounded by a compounding ratio (P/B ratio) which is represented by a ratio of a mass proportion of a dried pigment to a mass proportion of a dried adhesive agent and may have a compounding ratio preferably in a range of from 1.5 to 15 and more preferably in a range of from 3 to 7. The base paper is apt to lose smoothness if having a higher compounding ratio.

Examples of the water repellent agents include polyethylene waxes, synthetic waxes, microcrystalline waxes, higher fatty acids or salts of them, petroleum waxes, alkylketene dimers, silicone resins, chromium complex salts, fluorocarbon resins, etc. These water repellent agents may be used individually or in any combination of two or more. It is preferred for the coating layer to contain a water repellent agent or water repellent agents in a range of from 0.1 to 15% by mass in solid proportion.

Examples of the water resisting agents include ammonium zirconium carbonate, urea-formaldehyde resins, melamine-formaldehyde resins, polyamide-urea resins, urea-glyoxal resins, polyamide-polyamine-epichlorohydrin resins, polyamide-epoxy resins, ketone-aldehyde resins, aldehyde starches, etc. These water resisting agents may be used individually or in any combination of two or more. It is preferred for the coating layer to contain a water resisting agent or water resisting agents in a range of from 0.1 to 15% by mass in solid proportion. The water resisting agent is useful in conjunction with the water repellent agent in order to enhance the water resisting property of the paper base support.

The coating layer may contain auxiliary agents known in the art as appropriate in addition to the constituent additives described above. Examples of the auxiliary agents include a dispersant for pigment, a water-retention agent, a viscosity improver, an antifoaming agent, an antiseptic agent, a coloring agent, a wetting agent, a plasticizer, a fluorescent dye, an ultraviolet absorbing agent, an antioxidant agent, a cationic polymer electrolyte, etc.

The coating layer can be formed by coating at least one surface of the base paper with the coating liquid as described above by the use of, for example, a blade coater, an air knife coater, a roll coater, a comma coater, a brush coater, a squeeze coater, a curtain coater, a kiss coater, a bar coater, a gravure coater or the like. A spread of the coating liquid is preferably in a range of from 2 to 50 g/m$^2$ and more preferably in a range of from 3 to 30 g/m$^2$ in solid proportion. The coating layer is not bounded by thickness and may have a thickness preferably in a range of from 1 to 45 μm. The coating layer can be dried by the use of, for example, an air floating dryer, an infrared dryer, a cylinder dryer or the like.

It is preferred to apply surface treatment to the coating layer by bringing a device, having a smooth surface, preferably a metal roll having a mirror surface, into contact against the coating layer so as thereby to transfer a surface texture of the smooth surface to the coating layer. The surface treatment is not bounded by how a surface texture is transferred and may take any form well known in the art. One of preferred examples of the surface texture transferring form is a cast coating method that comprises the steps of applying a coating liquid to the base paper to form a coating layer, pressing a metal cast drum with its surface heated against the coating layer while the coating layer or the surface of the coating layer remains wet or flexible so as thereby to transfer the surface texture of the metal cast drum to the coating layer during drying the coating layer.

The cast coating method is not bounded by types and may take any type well known in the art. Examples of the cast coating methods include a wet cast coating method, a gelled cast coating method, a re-wet cast coating method, etc. While it is common with these methods to form a highly glossy surface of a cast coating layer by transferring a surface texture of a mirror finished cast drum surface to the cast coating layer, nevertheless, these methods have the differences in the process before the cast drum is brought into press-contact with a coating liquid applied to a base paper, as described below.

Referring to FIG. 1 schematically showing a process of the wet cast method, a coating liquid is applied to a base paper sheet 11 after press-drying by a coater 13 to form a cast coating layer on the base paper sheet 11, and then, the base paper sheet 11 is pressed against a mirror finished surface of a cast drum 10 while the cast coating layer of the coating liquid remains wet.

Figure 2:
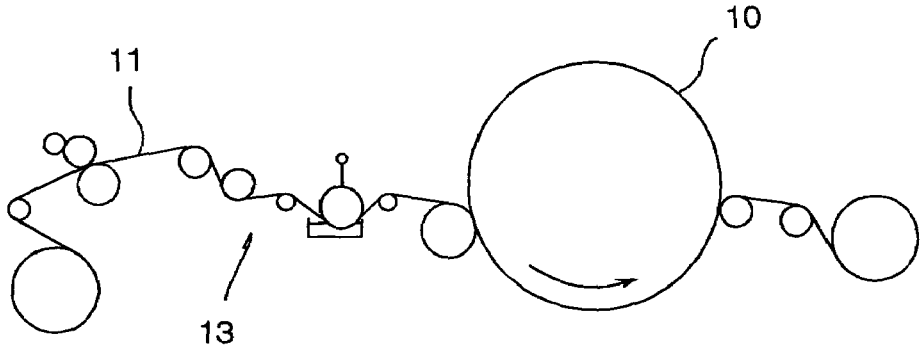
FIG. 2 is a schematic view illustrating an example of a gel-cast process.

Referring to FIG. 2 schematically showing a process of the gelled cast method, a coating liquid treated with a coagulating solution is applied to a base paper sheet 11 after press-dying by a coater 13 to form a cast coating layer on the base paper sheet 11, and then, the base paper sheet 11 is pressed against a mirror finished surface of a cast drum 10 while the coating liquid remains gelled and is not fluid. In this case, examples of a coagulating agent to be contained in the coagulating solution include salts of calcium such as formic acids, acetic acids, citric acids, dihydroxysuccinic acids, lactic acids, hydrochloric acids, sulfuric acids, carbonic acids, etc., zinc, magnesium, sodium, kalium, barium, lead, cadmium, ammonium; borax; borate salts; etc. These coagulating agents may be selectively used individually or in any combination of two or more.

Figure 3:
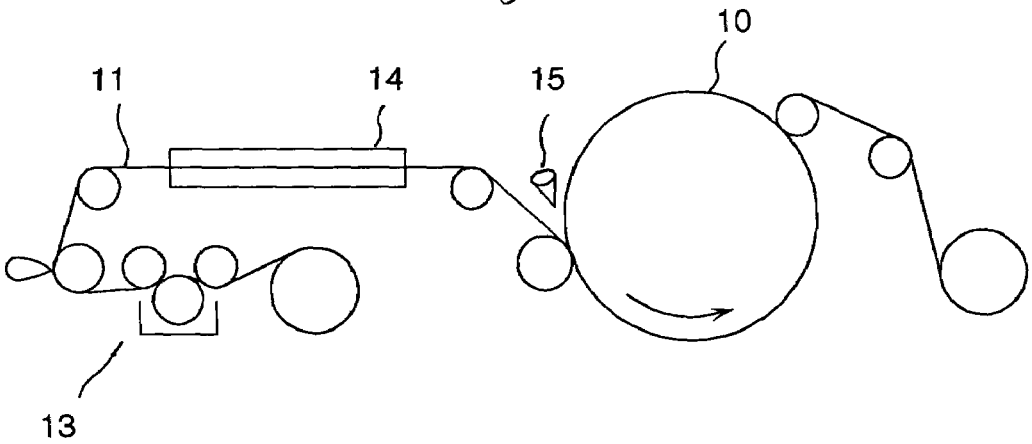
FIG. 3 is a schematic view illustrating an example of a rewet-cast process.

Referring to FIG. 3 schematically showing a process of the re-wet cast method, a coating liquid is applied to a base paper sheet 11 after press-drying by a coater 13 to form a cast coating layer on the base paper sheet 11 and is dried once by a dryer 14. Subsequently, after applying a wetting solution made from water as a major constituent to the dried cast coating layer by an applicator 15 so as to make the cast coating layer wet and flexible, the base paper sheet 11 with the cast coating layer formed thereon is pressed against a mirror finished surface of a cast drum 10 while the cast coating layer remains wet and flexible. According to the re-wetting cast method, a cast-coated paper sheet having a smooth and finely glossy surface is produced. In this case, examples of a wetting agent to be contained in the wetting solution include ammonium salts, polyamide resins, phosphorus compounds of hexametaphosphate, amide compounds, fluoride, zinc sulfate, calcium formate, etc. These wetting agents may be selectively used individually or in any combination of two or more. The re-wetting cast method is superior in productivity to the remaining methods.

In any method, the cast drum 10 is made from a cylindrical drum having a mirror finished surface and is used at a surface temperature ordinarily in a range of 80 to 150° C.

It is preferred to form a polymer covering layer on each of top and wire side surfaces of the base paper. Preferred resins for the polymer covering layer are such as having a film formative ability. Among such resins, polyolefin resins are preferred. Examples of the polyolefin resins include polyethylene, polypropylene, blends of polyethylene and polypropylene, high density polyethylene, blends of high density polyethylene and low density polyethylene, etc.

The polymer covering layer is not bounded by coating methods. Examples of available coating methods include an ordinary laminating method, a consecutive laminating method, a laminating method using a foot-block type, a multi-manifold type or a multi-slot type of single- or multi-layer extrusion die or a laminator. The single- or multi-layer extrusion die is not bounded by shape and is preferred to be a T-die or a coat hanger die. It is preferred for the polymer covering layer to have a thickness in a range of from 10 to 50 μm for a top side surface and a thickness in a range of from 10 to 50 μm for a wire side surface.

The paper base support thus prepared has high smoothness and fine glossiness sufficiently enough for various image recording media including an electrophotographic recording paper, a heat sensitive paper, an ink-jet recording paper, a sublimation transfer recording paper, a silver halide photographic paper, a thermal development recording paper.

An image recording medium of the present invention comprises the paper base support as described above and an image recording layer, and other layers as appropriate, formed on one surface of the paper base support. The image recording medium is different according to applications and types such as electrophotographic recording paper, heat sensitive recording paper, sublimation transfer recording paper, thermal transfer recording paper, silver halide photographic recording paper, ink-jet recording paper, etc.

The electrophotographic recording paper (which is hereinafter referred to as an electrophotographic paper) comprises the paper base support and at least one toner receptor layer formed as an image recording layer on the paper base support. It is allowed to form one or more layers selected from a group of a surface protective layer, a backing layer, an intermediate layer, an under cast coating layer, a cushioning layer, an electrostatic charge control (antistatic) layer, a reflection layer, a color tincture adjusting layer, a storage stability improving layer, an anti-adhesion layer, an anti-curling layer, a smoothing layer, etc.

The toner receptor layer receives a color toner or a black toner for image formation. The toner receptor layer receives a toner from a development drum or an intermediate transfer medium by means of (static) electricity or pressure during a toner image transfer process and is solidified with heat or pressure in a toner image fixing process. The toner receptor layer is preferred to be low in transparency and to have an optical transmittance preferably less than 80% and more preferably less than 73% in light of providing a feel like a photographic print. The optical transmittance can be found by, for example, measuring an optical transmittance of a sample toner coating film, having the same thickness as the toner receptor layer, formed on a polyethylene terephthalate film of 100 μm in thickness on a direct reading Hayes meter (for example Model HGM-2DP: Suga Testing Machine Co., Ltd.).

The toner receptor layer contains at least a thermoplastic resin and, if needed, various additives for the purpose of improving thermo-dynamic properties of the toner receptor layer such as a releasing agent, a plasticizing agent, a coloring agent, a filler, a cross-linking agent, an electrostatic charge control agent, an emulsifying agent, and a dispersing agent.

Examples of the thermoplastic resin for the toner receptor layer include, but not limited to, (1) polyolefin resins, (2) polystyrene resins, (3) acrylic resins, (4) polyvinyl acetate or derivatives of polyvinyl acetate, (5) polyamide resins, (6) polyester resins, (7) polycarbonate resins, (8) polyether resins or acetal resins, and (9) other resins. These thermoplastic resins may be selectively used individually or in any combination of two or more. Among them, it is preferred in light of toner burying to employ acrylic resins, polyvinyl acetate or polyester resins which are high in cohesive energy.

Examples of (1) the polyolefin resins include polyolefin resins such as polyethylene and polypropylene, copolymer resins of olefin such as ethylene or propylene polymerized with vinyl monomers. Examples of the copolymer resins of olefin and vinyl monomers include ethylene-vinyl acetate copolymers and ionomer resins that are copolymers polymerized with an acrylic acid or a methacrylic acid. In this instance, examples of derivatives of polyolefin resin include chlorinated polyethylene and chlorosulfonated polyethylene.

Examples of (2) the polystyrene resins include polystyrene resins, styrene-isobutylene copolymers, styrene-isobutylene copolymers, acrylonitrile-styrene copolymers (AS resins), acrylonitrile-butadiene-styrene copolymers (ABS resins), polystyrene-maleic anhydride resins, etc.

Examples of (3) the acrylic resins include polyacrylic acids or their ester, polymethacrylic acids or their ester, polyacrylonitrile, polyacrylamide, etc. These ester are different in property according to ester groups. Further, examples of them include copolymers polymerized with other monomers such as acrylic acids, methacrylic acids, styrene, vinyl acetate, etc. The polyacrylonitrile is used in the form of a copolymer of the AS resin or ABS resin rather than in the form of homopolymer.

Examples of (4) the polyvinyl acetate or their derivatives include polyvinyl acetate, polyvinyl alcohol derived by saponifying polyvinyl acetate, and polyvinyl acetal resins derived by reacting polyvinyl alcohol to aldehyde such as formaldehyde, acetaldehyde, butylaldehyde, etc.

Examples of (5) the polyamide resins, that are condensation polymers with diamine and dibasic acid, include, for example, 6-nylon and 6,6-nylon.

Examples of (6) polyester resins can be produced from condensation polymerization with acid and alcohol. The polyester resins are significantly different in property according to combinations of acid and alcohol. Examples of the polyester resins include, but not limited to, maleic acids, fumaric acids, citraconic acids, itaconic asids, glutaconic asids, phthalic acids, terephthalic acids, iso-phthalic acids, succinic acids, adipic acids, cebacis acids, azelaic acids, malonic acids, n-dodecenylsuccinic acids, iso-dodecenylsuccinic acids, n-dodecyl-succinic acids, iso-dodecylsuccinic acids, n-octenylsuccinic acids, iso-octenylsuccinic acids, n-octylsuccinic acids, iso-octylsuccinic acids, triimllitic acids, pyromellitic acids, anhydride of these acids, lower alkyl ester of these acids.

The alcohol constituent is not bounded by species, and it is preferred to use, for example, dihydric alcohol. Examples of aliphatic diol include ethylene glycol, diethylene glycol, triethylene glycol, 1,2-propylene glycol, 1,3-propylene glycol, 1,4-butanediol, neo-pentyl glycol, 1,4-butenediol, 1,5-pentanediol, 1,6-hexanediol, 1,4-cyclohexane dimethnol, dipropylene glycol, polyethylene glycol, polypropylene glycol, polytetremethylene glycol, etc. Examples of bisphenol A with an addition of alkylene oxide include polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxypropylene (2.0)-polyoxy-ethylene (2,0) 2,2-bis(4-hydroxyphenyl) propane, polyoxypropylene(6)-2,2-bis(4-hydroxylphenyl) propane, etc.

Examples of (7) the polycarbonate resins include polycarbonic acid ester derived from bisphenol A and phosgene.

Examples of the polyether resins include polyethylene oxides and polypropylene oxides. Further, examples of (8) the acetal resins include ring opening polymers such as poly-oxymethylene.

Examples of (9) the other resins include polyaddition polyurethane resins.

In this instance, it is preferred that each individual thermoplastic resin is such that the toner receptor layer comprising the thermoplastic resin in a tangible form satisfies solid state properties described later and more preferred that each individual thermoplastic resin itself satisfies the solid state properties. It is also preferred to use two more of the thermoplastic resins different in solid state properties required for the toner. More specifically, it is preferred for the thermoplastic resin for the toner receptor layer to have a molecular weight greater than a molecular weight of a thermoplastic resin used for a toner. However, this relationship of molecular weight between these two thermoplastic resins for the toner receptor layer and the toner is not always preferred depending upon the relationship of thermodynamic characteristics between them. Taking an instance, in the case where the thermoplastic resin for the toner receptor layer has a softening temperature higher than the thermoplastic resin for the toner, it is preferred in some cases that the thermoplastic resin for the toner receptor layer has a molecular weight equal to or less than the thermoplastic resin for the toner.

It is preferred to use a mixture of different thermoplastic resins identical in composition but different in average molecular weight for the toner receptor layer. The desirable relationship of molecular weight between the thermoplastic resins for the toner receptor layer and the toner is such as disclosed in Unexamined Japanese Patent Publication No. 8 (1996)-334915. It is further preferred for the thermoplastic resin for the toner receptor layer to have a molecular weight distribution wider than the thermoplastic resin for the toner and to satisfy solid state properties described in, for example, Unexamined Japanese Patent Publication Nos. 5-127413, 8-194394, 8-334915, 8-334916, 9-171265 and 10-221877.

Water-dispersant polymers or water-soluble polymers are favorably used as the polymer for the toner receptor layer for the following reasons. That is, these aqueous polymer do not emit an organic solvent in a coating and drying process, so as to be superior in environmental adaptability and suitability for working, and a releasing agent such as wax is generally hard to dissolve in a solvent at an ambient temperature and is dissolved in a solvent such as water or an organic solvent in advance of use. Further, the water-soluble type of polymer is stable and superior in adaptability to production method, and aqueous coating easily bleeds onto a surface in the coating and drying process so as thereby to bring about an effect of a releasing agent.

The aqueous resin is not bounded by its component, bond-structure, molecular geometry, molecular weight, molecular weight distribution, etc. as long as it is a water-soluble polymer or a water-dispersant polymer. Examples of aqueous groups of the polymer include a sulfonic acid groups, a hydroxyl group, carboxylic acid group, an amino acid group, an amide group, an ether group, etc.

Examples of the water-dispersant polymers include resin dispersions, copolymers, mixtures and cation modified products of the polymers (1) to (9) described above. These polymers may be selectively used individually or in any combination of two or more. Synthesized water-dispersant polymers may be used. Commercially available examples of the synthesized water-dispersant polymers a Vyronal series of polyester polymers (Toyobo Co., Ltd.), a Pesuresin A series of polyester polymers (Takamatsu Oil & Fats Co., Ltd.), a Tafuton UE series of polyester polymers (Kao Co., Ltd.), a Polyester WR series of polyester polymers (Nippon Synthetic Chemical Industry Co., Ltd.), an Eliel series of polyester polymers (Unitika Ltd.), Hyros XE series of acrylic polymers, Hyros KE series of acrylic polymers and Hyros PE series of acrylic polymers (Seiko Chemical Industry Co., Ltd.), and Jurimar ET series of acrylic polymers (Nippon Fine Chemical Co., Ltd.).

The water-dispersant emulsions are not bounded by species as long as having an average volumetric particle size greater than 20 nm. Examples of the water-dispersant emulsions include water-dispersant polyurethane emulsions, water-dispersant polyester emulsions, chloroprene emulsions, styrene-butadiene emulsions, nitrile-butadiene emulsions, butadiene emulsions, vinyl chloride emulsions, vinylpyridine-styrene-butadiene emulsions, polybutene emulsions, polyethylene emulsions, vinyl acetate emulsions, ethylene-vinyl acetate emulsions, vinylidene chloride emulsions, methylemetacrylate-butadiene emulsions, etc. Among them, it is preferred to use water-dispersant polyester emulsions. It is preferred that the water-dispersant polyester emulsion is of a self-dispersant aqueous type. Among them, carboxyl group contained self-dispersant aqueous polyester resin emulsions are especially preferred. In this instance, the self-dispersant aqueous polyester emulsion as used herein shall mean and refer to aqueous emulsions including polyester resins capable of self-dispersing in aqueous solvent without the aid of emulsifiers or the like, and the carboxyl group contained self dispersant aqueous polyester resin emulsion as used herein shall mean and refer to an aqueous emulsion containing polyester resins containing carboxyl groups as a hydrophilic group and capable of self-dispersing in an aqueous solvent.

It is preferred that the self-dispersant aqueous polyester emulsion satisfies the following properties (1) to (4) in relation to a polymer for an intermediate layer which will be described later. This is because that, since the self-dispersant aqueous polyester emulsion contains no surface active agent, it is less hydroscopic even in a highly humid atmosphere, shows a small drop in softening point due to moisture, and is prevented from causing offset during fixation of the resin cast coating layer and adhesion defects between papers during storage. Furthermore, because the aqueous polyester emulsion is apt to affect a molecular geometry that is high in cohesive energy, it takes a low elastic or low viscous molten state in a fixation process of an electrophotographic paper with a toner receptor layer while having sufficient hardness in a conservative environment, so as to provide sufficiently high image quality resulting from disposition of toner particles in the toner receptor layer.

(1) Number-average molecular weight (Mn): preferably in a range of from 5,000 to 10,000, and more preferably in a range of from 5,000 to 7,000

(2) Molecular weight distribution (weight-average molecular weight Mw/number-average molecular weight Mn): preferably less than 4, more preferably equal to or less than 3

(3) Glass transition temperature (Tg): preferably in a range of from 40 to 100° C., and more preferably in a range of from 50 to 80° C.

(4) Volumetric-average particle size: preferably in a range of from 20 to 200 μm, and more preferably in a range of from 40 to 150 nm It is preferred that the toner receptor layer contains an aqueous emulsion in a range of from 10 to 90% by mass, and more preferably in a range of from 10 to 70% by weight.

The water-soluble polymers are not bounded by weight-average molecular weight (Mw) as long as having a weight-average molecular weight (Mw) less than 400,000 and may be synthesized. It is allowed to use commercially available water soluble polymers such as polyvinyl alcohol, carboxy modified polyvinyl alcohol, carboxymethyl cellulose, hydroxyethyl cellulose, cellulose sulfate, polyethylene oxides, gelatin, cationic starch, casein, sodium polyacrylate, sodium styrene-maleic anhydride copolymers, polystyrene sodium sulfonate, etc. Among them, it is preferred to use polyethylene oxides.

More specifically, commercially available examples of the water soluble polymers include a Pluscoat series of water-soluble polymers (Gao Chemical Industry Co., Ltd.), a Fintex ES series of water-soluble polymers (Dainippon Ink & Chemical Inc.), a Jurimar AT series of water-soluble acryl (Nippon Fine Chemical Co., Ltd.), Fintex 6161 and K-96 series of water-soluble acryl (Dainippon Ink & Chemical Inc.), and Hyros NL-1189 and Hyros BH-997L series of water-soluble acryl (Seiko Chemical Industry Co., Ltd.), etc.

Further examples of the water-soluble polymers include those disclosed in Research Disclosure (RD) Vol. 17, No. 643, page 26; Vol. 18, No. 716, page 651; Vol. 307, No. 105, pages 873 and 874; and Unexamined Japanese Patent Publication No. 64-13546. The toner receptor layer is not bounded by polymer content and preferred to have a polymer content in a range of from 0.5 to 2 g/m$^2$. The thermoplastic resin may used in combination with another polymer material and, in such the case, the toner receptor layer has a thermoplastic resin content preferably greater than 10% by mass, more preferably greater than 30% by mass and most preferably in a range of from 50 to 90% by mass.

The releasing agents are blended in the toner receptor layer in order to prevent an occurrence of offsets. The releasing agents are not bounded by species as long as being capable of forming a layer resulting from hot solution at a fixing temperature with the consequence that the releasing agent is separated out and unevenly distributed on a surface of the toner receptor layer, and cold solidification.

Examples of the releasing agents include silicon compounds, fluorine compounds, waxes and matting agents. Specifically, examples of the releasing agents include waxes disclosed in "Revised Edition: Property and Application of Wax" (published by Koushobou), silicone compounds disclosed in "Silicone Handbook" (published by Nikkan Kogyo Shinbun), and silicone compounds, fluorine compounds and waxes that are used for toners such as disclose in Japanese Patent Nos. 2,838,498 and 2,949,558; Japanese Patent Publication Nos. 59-38581 and 4-32380; Unexamined Japanese Patent Publication Nos. 50-117433, 52-52640, 57-148755, 61-62056, 61-62057, 61-118760, 2-42451, 3-41465, 4-212175, 4-214570, 4-263267, 5-34966, 5-119514, 6-59502, 6-161150, 6-175396, 6-219040, 6-230600, 6-295093, 7-36210, 7-43940, 7-56387, 7-56390, 7-64335, 7-199681, 7-223362, 7-287413, 8-184992, 8-227180, 8-248671, 8-2487799, 8-248801, 8-278663, 9-152739, 9-160278, 9-185181, 9-319139, 9-319143, 10-20549, 10-48889, 10-198069, 10-207116, 11-2917, 11-44969, 11-65156, 11-73049 and 11-194542. These compounds may be selectively used individually or in any combination of two or more.

Examples of the silicone compounds include silicone oils, silicone rubbers, silicone fine particles, silicone-modified resins, reactive silicone compounds, etc.

Examples of the silicone oils include non-modified silicone oils, amino-modified silicone oils, carboxy-modified silicone oils, carbinol-modified silicone oils, vinyl-modified silicone oils, epoxy-modified silicone oils, polyether-modified silicone oils, silanol-modified silicone oils, methacryl-modified silicone oils, mercapto-modified silicone oils, alcohol-modified silicone oils, alkyl-modified silicone oils, fluorine-modified silicone oils, etc.

Examples of the silicone-modified resins include silicone-modified products of olefin resins, polyester resins, vinyl resins, polyamide resins, cellulose resins, phenoxy resins, vinyl chloride-vinyl acetate resins, urethane resins, acryl resins, styrene-acryl resins, or copolymer resins of them.

Examples of the fluorine compounds include, but not limited to, fluorine oils, fluorine rubbers, fluorine-modified resins, fluorine sulfonate compounds, fluorosulfonic acids, fluorine compounds, salts of fluorine compounds, inorganic fluoride, etc.

The waxes are classified broadly into two types, namely natural waxes and synthetic waxes. Examples of the natural waxes include vegetable waxes, animal waxes, mineral waxes and petroleum waxes. Among them, the vegetable waxes are especially preferable. In particular, water-dispersant natural waxes are preferred in light of compatibility in the case where an aqueous resin is used for a polymer of the toner receptor layer.

Examples of the vegetable waxes include, but not limited to, waxes, commercially available or synthetic, conventionally known in the art. Specifically, examples of the vegetable waxes include carnauba waxes, one of which is commercially available as EMUSTAR-0413 (Ito Oil Manufacturing Co., Ltd.) or Serozole 524 (Chukyo Oils & Fats Co., Ltd.), castor oils one of which is fine castor oil commercially available from Ito Oil Manufacturing Co., colza oils, soybean oils, sumac waxes, cotton waxes, rice waxes, sugarcane waxes, canderyla waxes, Japan waxes, jojoba oils, etc. Among them, the carnauba waxes having melting temperatures in a range of from 70 to 95° C. are especially preferred in light of providing the electrophotographic papers that excel in offset resistance, adhesion resistance, transport quality and a glossy impression, hardly cause cracks and form high quality images.

Examples of the animal waxes include, but not limited to, bees waxes, lanolin, spermaceti, blubber (whale oil), wool wax, etc. which are conventionally known in the art.

Examples of the mineral waxes include, but not limited to, waxes, commercially available or synthetic, conventional known in the art such as montan waxes, montan ester waxes, ozokerite, ceresin, etc. Among them, the montan waxes having melting temperatures in a range of from 70 to 95° C. are especially preferred in light of providing the electrophotographic papers that excel in offset resistance, adhesion resistance, transport quality and glossy impression, and hardly cause cracks and form high quality images.

Examples of the petroleum waxes include, but not limited to, waxes, commercially available or synthetic, such as paraffin waxes, microcrystalline waxes, petrolatum, etc. conventional known in the art, It is preferred that the toner receptor layer has the natural wax content in a range of from 0.1 to 4 g/m$^2$, and more preferably in a range of from 0.2 to 2 g/m$^2$. If the natural wax content is less than 0.1 g/m$^2$, significant deterioration in, in particular, offset resistance and adhesion resistance is possibly encountered. On the other hand, if the natural wax content is beyond 4 g/m$^2$, the wax is too much to prevent an occurrence of deterioration in image quality. It is preferred that the natural wax has a melting temperature in a range of from 70 to 95° C., and more preferably in a range of from 75 to 90° C., in light of, in particular, offset resistance and transport quality.

Examples of the synthetic waxes are classified into several types, namely synthetic hydrocarbons, modified waxes, hydrogenated waxes, and other fat and oil synthetic waxes. These waxes are preferred to be of a water-dispersant type in light of compatibility in the case where an aqueous thermoplastic resin is used in the toner receptor layer.

Examples of the synthetic hydrocarbons include Fischer-Tropsch waxes, polyethylene waxes, etc. Examples of the fat and oil synthetic waxes include acid amide compounds such as amide stearate, acid imide compounds such as phthalic anhydride imide, etc.

Examples of the modified waxes include, but not limited to, hydrogenated ricinus, derivatives of hydrogenated ricinus, stearic acids, lauric acids, myristic acids, palmitic acids, behenic acids, sebacic acids, undecylenic acids, heptyl acids, maleic acids, higher maleinized oil, etc.

Besides the above releasing agents to be added in a toner, it is allowed to use derivatives of them, oxides of them, refined products of them or mixtures of them for the releasing agent. These materials may have reactive substituents.

It is preferred for the releasing agent to have a melting temperature in a range from 70 to 95° C. in light of offset resistance and transport quality. Further, it is preferred that the releasing agent is contained in the toner receptor layer in a range of from 0.1 to 10% by mass, more preferably in a range from 0.3 to 8.0% by mass, and most preferably in a range from 0.5 to 5.0% by mass, with respect to the total mass of toner receptor layer. If the releasing agent content is less than 0.1% by mass, significant deterioration in, in particular, offset resistance and adhesion resistance will occur. On the other hand, if the releasing agent content is beyond 10% by mass, the releasing agent is too much to prevent an occurrence of a deterioration in image quality.

The plasticizer, that is not bounded by species and may be of a conventionally well known type, has the function of controlling fluidization or softening of the toner receptor layer due to heat and/or pressure applied in the toner fixing process. Examples of the plasticizers include, but not limited to, those disclosed in "Handbook Of Chemistry" by Chemical Society of Japan (Maruzen), "Plasticizer—Theory and Applications—" by Kouichi Murai (Koushobou), "Study On Plasticizer Vol. 1" and "Study On Plasticizer Vol. 2," both by Polymer Chemistry Association, or "Handbook Rubber Plastics Compounding Chemicals" (Rubber Digest Ltd.). Further, although there are plasticizers exemplified as high boiling organic solvents or thermal solvents, preferable examples of the plasticizes include compounds such as of esters (e.g. phthalate esters, phosphate esters, fatty acid esters, abietate, adipate, sebacate, azelate, benzoate, butyrate, epoxidized fatty acid esters, glycolate, propionate, trimellitate, citrate, sulfonate, calboxylate, succinate, maleate, fumarate, futalate, stearate, etc.), compounds of amide (e.g. fatty acid amide, sulfoamide, etc.), ether, of alcohol, lactone, polyethyleneoxy and the like that are described in, for example, Japanese Unexamined Patent Publication Nos. 59(1984)-83154, 59(1984)-178451, 59(1984)-178453, 59(1984)-178454, 59(1984)-178455, 59(1984)-178457, 61(1986)-09444, 61(1986)-2000538, 62(1987)-174745, 62(1987)-245253, 62(1987)-8145, 62(1987)-9348, 62(1987)-30247, 62(1987)-136646, and 2(1990)-235694. These plasticizing agents can be used as a mixture with a resin.

Polymers having comparatively low molecular weights may be used as the plasticizer. It is preferred for these polymers to have molecular weights less than that of a binder resin that is to be plasticized. Specifically, the molecular weight of the polymer is preferably less than 15000 and more preferably less than 5000 and to be of the same type as a binder resin that is to be plasticized. For example, when plasticizing polyester resins, it is preferred to use polyester having a low molecular weight. Further, oligomers may be used as the plasticizer. Commercially available examples of the plasticizers other than the aforementioned compounds include Adecasizer PN-170 and Adecasizer PN-1430 (Asahi Denka Kogyo K. K.), PARAPLEX-G-25, PARAPLEX-G-30 and PARAPLEX-G40 (C.P. HALL Corporation), and Estergum 8L-JA, Ester R-95, Pentarayn 4851, Pentaryn FK115, Pentaryn 4820, Pentaryn 830, Ruizol 28-JA, Picorastic A75, Picotex LC, and Crystalex 3085 (Rika Hercules Co., Ltd.).

It is possible to make optional use of the plasticizer in order to reduce stress or strain (physical strain due to elastic force or viscosity, or strain due to mass balance of molecules, binder main chains and pendants) that occurs when toner particles are buried in the toner receptor layer. The plasticizer may be present in a microscopically dispersed state, a microscopically phase separated state like a sea-island state, or a state where the plasticizer has mixed with and dissolved in other components such as a binder sufficiently, in the toner receptor layer. The plasticizer may be utilized for the purpose of optimizing sliding quality (improvement of transport quality due to a reduction in frictional force), improving offset quality (separation of a toner to the fixing device), and adjusting a curling balance and static build-up (formation of electrostatic toner image). The plasticizer content of the toner receptor layer is preferably in a range of from 0.001 to 90% by mass, more preferably in a range of from 0.1 to 60% by mass, and most preferably in a range of from 1 to 40% by mass.

Examples of coloring agents include, but not limited to, fluorescent brightening agents, white pigments, colored pigments, dye, etc. Various fluorescent brightening agents conventionally known in the art can be used without any particular restrictions as long as they have absorptive power in near-ultraviolet region and generate fluorescence in a wavelength band from 400 to 500 nm. Specifically, compounds disclosed in, for example, "The Chemistry of Synthetic Dyes" by K. Veen Ratarman, Vol. V, Chapter 8, may be used as the fluorescent brightening agent. Further, examples of the fluorescent brightening agent include synthesized agents such as stilbene compounds, coumarin compounds, biphenyl compounds, benzoxazoline compounds, naphthalimide compounds, pyrazoline compounds, carbostyryl compounds, etc. and, as commercially available products, White Fulfa-PSN, White AFufa-PHR, White Fulfa-HCS, White Fulfa-PCS, White Fulfa-B (manufactured by Sumitomo Chemical Co., Ltd.) and UVITEX-OB (manufactured by Chiba-Geigy Ltd.).

Example of the white pigments include, but not limited to, those conventionally known in the art, namely inorganic pigments such as titanium oxides, calcium carbonates, etc.

Examples of the colored pigments include, but not limited to, various pigments such as disclosed in, for example, Unexamined Japanese Patent Publication No. 63-44653, azo pigments, polycyclic pigments, condensation polycyclic pigments, lake pigments, lake pigments, inorganic pigments, carbon black etc. Examples of the azo pigments includes azolake such as carmine 6B, red 2B, etc.; insoluble azo pigments such as monoazo yellow, diazo yellow, pyrazolon orange, Balkan orange, etc.; condensed azo pigments such as chromophthal yellow and chromophthal red, and the like.

Examples of the polycyclic pigments include phthalocyanine pigments such as copper phthalocyanine blue, copper phthalocyanine green, etc. Examples of the condensation polycyclic pigments include dioxazine pigments such as dioxazine violet, etc.; isoindolynone pigments such as indolynone yellow, etc.; slen pigments, perylene pigments, perynon pigments, thioindigo pigments and the like. Examples of the lake pigments include malachite green, rhodamine B, rhodamine G, Victoria blue B, etc. Examples of the inorganic pigments include oxides such as titanium dioxides, colcothar, etc.; sulfate such as precipitated barium sulfate, etc.; carbonates such as precipitated calcium carbonate, etc.; silicate such as hydrated silicate, anhydrous silicate, etc.; metal powder such as aluminum powder, bronze powder, blue powder, chrome yellow, iron blue; and the like.

These colored pigments may be selectively used individually or in any combination of two or more.

Example of the dye include, but not limited to, those conventionally known in the art such as anthraquinone compounds and azo compounds. Examples of water-insoluble dye include vat dyes such as C.I. Vat violet 1, C.I. Vat violet 2, C.I. Vat violet 9, C.I. Vat violet 13, C.I. Vat violet 21, C.I. Vat blue 1, C.I. Vat blue 3, C.I. Vat blue 4, C.I. Vat blue 6, C.I. Vat blue 14, C.I. Vat blue 20, C.I. Vat blue 35, etc.; dispersive dyes such as C.I. disperse violet 1, C.I. disperse violet 4, C.I. disperse violet 10, C.I. disperse blue 3, C.I. disperse blue 7, C.I. disperse blue 58, etc.; and oil-soluble dyes such as C.I. solvent violet 13, C.I. solvent violet 14, C.I. solvent violet 21, C.I. solvent violet 27, C.I. solvent blue 11, C.I. solvent blue 12, C.I. solvent blue 25, C.I. solvent blue 55, etc. Colored couplers used in silver salt photography can be preferably utilized.

The coloring agent content is preferably in a range from 0.1 to 8 $g/m^2$, and more preferably in a range from 0.5 to 5 $g/m^2$, with respect to the toner receptor layer. If the coloring agent content is less than 0.1 $g/m^2$, the toner receptor layer has a light transmittance too high. On the other hand, if the coloring agent content is beyond 8 $g/m^2$, the toner receptor layer is possibly apt to become poor in tractability concerning adhesion resistance and cracks. In particular among the coloring agents, the pigment content is preferably less than 40% by mass, more preferably less than 30% by mass, and most preferably less than 20% by mass, with respect to the mass of the thermoplastic resin in the toner receptor layer.

Examples of the fillers include various fillers, organic or inorganic, and those conventionally known in the art as stiffeners, loading materials and reinforcing materials for binder resins. The filler can be selected consulting "Handbook: Rubber•Plastics Composing Chemicals" (Rubber Digest Ltd.), "New Edition: Plastic Composing Chemicals: Fundamentals and Applications" (Taiseisha), and "Filler Handbook" (Taiseisha). Preferable examples of inorganic fillers and inorganic pigments available for the filler include silica, alumina, titanium dioxides, zinc oxides, zirconium oxides, mica-like ferric oxides, zinc white, lead oxides, cobalt oxides, strontium chromate, molybdenum pigments, smectite, magnesium oxides, calcium oxides, calcium carbonates, mullite, etc. Among them, silica and alumina are especially preferable. These fillers may be selectively used individually or in any combination of two or more. It is desirable for the filler to have smaller particle sizes. If the filler particles are too large in size, the toner receptor layer is apt to have a coarse surface.

There are two types of silica available for the filler, i.e. spherical silica and amorphous silica. These silica can be synthesized in either a wet process, a dry process or an aerogel process. It is allowed to treat surfaces of hydrophobic silica particles with a trimethylsilyl group or silicon. In this instance, it is preferred to use colloidal silica particles that are desirably porous.

There are two types of alumina available for the filler, i.e. anhydrous alumina and alumina hydrate. The anhydrous alumina may be of a crystal form of $\alpha$, $\beta$, $\gamma$, $\delta$, $\zeta$, $\eta$, $\theta$, $\kappa$, $\rho$ or $\chi$. The alumina hydrate is more preferable rather than the anhydrous alumina There are two types of alumina hydrate, namely monohydrate such as pseudoboehmite, boehmite and diaspore, and trihydrate such as gibbsite and bayerite. The alumina particles are preferably porous. The alumina hydrate can be synthesized in either a sol-gel process in which alumina hydrate is precipitated by adding ammonia in a solution of alminium salt or a hydrolysis process in which an alkali aluminate is hydrolyzed. The anhydrous alumina can be derived by heating and dehydrating an alumina hydrate.

The filler content is preferred to be between 5 to 2000 parts by mass with respect to 100 parts by dry mass of a binder in the toner receptor layer.

A cross-linking agent may be added in order to adjust storage stability and thermoplasticity of the toner receptor layer. Examples of compounds available for the cross-linking agent include those having two or more reactive groups such as an epoxy group, an isocyanate group, an aldehydo group, an active halogen group, an active methylene group, an acetylene group or conventionally known reactive group, in one molecule. Aside from these compounds, available compounds are those having two or more groups capable of forming a bond through an ionic bond, a hydrogen bond, a coordinate bond, etc. Further examples of cross-linking agent include compounds conventionally known as a coupling agent, a hardening agent, a polymerizing agent, a polymerization promoter, a coagulating agent, a film forming ingredient, an auxiliary film forming ingredient and the like for resins. Examples of the coupling agent include chlorosilane, vinylsilane, epoxysilane, aminosilane, alkoxyaluminum chelate, titanate coupling agents and, additionally, include those disclosed in "Handbook: Rubber•Plastics Compounding Chemicals" (Rubber Digest Ltd.).

It is preferred for the toner receptor layer to contain an electrostatic charge control agent for the purpose of controlling toner transfer and toner adhesion. Examples of electrostatic charge adjusting agents include, but not limited to, various types of electrostatic charge control agents conventionally known in the art, namely surface-active agents such as cation surface-active agents, anion surface-active agents, amphoteric surface-active agents, nonion surface-active agents, etc. and, aside from those, polyelectrolytes, electroconductive metal oxides and the like. Specific examples of electrostatic charge control agent include cation antistatic agent such as quaternary ammonium salts, polyamine derivatives, cation-modified polymethylmethacrylate, cation-modified polystyrene, etc.; anionic antistatic agents such as alkylphosphate, anion polymers, etc.; and nonionic antistatic agents such as fatty ester, polyethylene oxides, etc. In the case where a toner is charged with negative electricity, the electrostatic charge control agent that is contained in the toner receptor layer is preferably of a catyon type or of a nonion type.

Examples of the electroconductive metal oxide include ZnO, $TiO_2$, $SnO_2$, $Al_2O_3$, $In_2O_3$, $SiO_2$, MgO, BaO, $MoO_3$, etc. These electroconductive metal oxides may be selectively used individually or in any combination of two or more thereof. The respective metal oxide may further contain, or may be doped with, hetero elements such as, for example, Al or In for ZnO, Nb or Ta for $TiO_2$, Sb, Nb or halogens for $SnO_2$.

The toner receptor layer may contain other additives for the purpose of improving stability of image formation thereon and stability of the image recording layer itself. Examples of the other additives include antioxidants, anti-aging agents, anti-degradation agents, anti-ozonants, ultraviolet absorption agents, metal complexes, light stabilizers, antiseptic agents, fungicide, etc. which are well known in the art. Specific examples of the antioxidants include, but not limited to, chroman compounds, coumaran compounds, phenolic compounds such as hindered phenol, hydroquinone derivatives, hindered amine derivatives, spiroindan compounds, etc. The antioxidants that are disclosed in, for example, Unexamined Japanese Patent Publication No. 61(1986)-159644 can be use.

Examples of the anti-aging agents include, but not limited to, those disclosed in "Handbook: Rubber•Plastics Compounding Chemicals 2$^{nd}$ Revised Edition" (1993, Rubber Digest Ltd.), pages 76~121.

Examples of the ultraviolet absorption agents include, but not limited to, benzotriazole compounds such as disclosed in U.S. Pat. No. 3,533,794, 4-thiazolidine compounds such as disclosed in U.S. Pat. No. 3,352,681, benzophenone compounds such as disclosed in Unexamined Japanese Patent Publication No. 46-2784, and ultraviolet absorption polymers such as disclosed in Unexamined Japanese Patent Publication No. 62-260152.

Examples of the metal complexes include, but not limited to, those disclosed in, for example, U.S. Pat. Nos. 4,241,155, 4,245,018 and 4,254,195, Unexamined Japanese Patent Publication Nos. 61-88256, 62-174741, 63-199248, 1-75568 and 1-74272. In addition, the ultraviolet absorption agents and the light stabilizers disclosed in "Handbook: Rubber•Plastics Composing Chemicals 2$^{nd}$ Revised Edition" (1993, Rubber Digest Ltd.), pages 122~137 are preferably used.

Photographic additives conventionally well known in the photographic art can be added to the toner receptor layer as appropriate. Examples of the photographic additives include those disclosed in Research Disclosure (RD) Nos. 17643 (December 1978), 18716 (November 1979) and 307105 November 1989). Pages on which these additives appear are shown in Table I.

TABLE I

| Additive | RD No. 17643 | RD No. 18716 | RD No. 307105 |
|---|---|---|---|
| Brightener | 24 | 648R | 868 |
| Stabilizer | 24-25 | 649R | 868-870 |
| Light Absorbent (UV Absorbent) | 25-26 | 649R | 873 |

TABLE I-continued

| Additive | RD No. 17643 | RD No. 18716 | RD No. 307105 |
|---|---|---|---|
| Color Dye Image Stabilizer | 25 | 650R | 872 |
| Film Hardener | 26 | 651L | 874-875 |
| Binder | 26 | 651L | 873-874 |
| Unstiffening Agent/Lubricant | 27 | 650R | 876 |
| Coating Auxiliary Agent (Surface-active Agent) | 26-27 | 650R | 875-876 |
| Antistatic Agent | 27 | 650R | 976-977 |
| Matting Agent | | | 878-879 |

The toner receptor layer of the image recording paper of the present invention is formed by applying a coating liquid containing a thermoplastic resin over the paper base support with, for example, a wire coater and drying it. A temperature for forming a thermoplastic resin film (MFT) is preferably higher than an ambient temperature for storage before recording and less than 100° C. for fixation of toner particles.

It is preferred for the toner receptor layer to have a dried spread desirably in a range from 1 to 20 g/cm$^2$ and more desirably in a range from 4 to 15 g/cm$^2$ and further to have a thickness desirably, but not limited to, greater than ½ of toner particle size and more desirably one to three times of toner particle size. More specifically, the thickness of the toner receptor layer is preferably in a range of from 1 to 50 μm or in a range of from 1 to 30 μm, more preferably in a range of from 2 to 20 μm, and most preferably in a range of from 5 to 15 μm.

It is preferred for the toner receptor layer to have a 180 degree separation strength with respect to a fixing member of an image forming apparatus less than 0.1 N/25 mm, and more preferably less than 0.041 N/25 mm, at a fixing temperature. The 180 degree separation strength is measured using a surface material of the fixing member by the method meeting JIS K6887.

It is preferred for the toner receptor layer to have a high whiteness, specifically higher than 85% when measured by the method meeting JIS P8123. It is further preferred for the toner receptor layer to have a spectral reflection coefficient higher than 85% in a wavelength range of from 440 to 640 nm and a difference between a peak and a bottom spectral reflection coefficient preferably less than 5% in the same wavelength range. Further, it is preferred for the toner receptor layer to have a spectral reflection coefficient higher than 85% in a wavelength range of from 400 to 700 nm and a difference between a peak and a bottom spectral reflection coefficient less than 5% in the same wavelength range.

More specifically, when specifying the whiteness in terms of CIE 1976 (L*a*b*) color space, it is preferred for the toner receptor layer to have an L* value desirably greater than 80, more desirably greater than 85 and most desirably greater than 90. The toner receptor layer has a white tincture that is preferred as neutral as possible and represented by a value of $(a^*)^2+(b^*)_2$ desirably less than 50, more desirably less than 18 and most desirably less than 5, in terms of CIE 1976 (L*a*b*) color space.

It is preferred for the toner receptor layer to have fine glossiness after image formation, specifically, a 45 degree glossiness between 60 and 110, and a lower limit 45 degree glossiness higher than 75, more preferably higher than 90, over a range from a white state in which no toner is present) to a black state in which a toner is present at the maximum density. However, if the 45 degree glossiness exceeds 110, the toner receptor layer shows metallic luster which leads to undesirable image quality. The 45 degree glossiness is measured by the method meeting JIS Z8741.

It is preferred for the toner receptor layer to have a high degree of smoothness after fixation. The smoothness after fixation is preferably less than 3 μm, more desirably less than 1 μm, and most desirably less than 0.5 μm, in terms of arithmetic average roughness (Ra) over a range of from the white state to the black state. The arithmetic average roughness is measured by the method meeting JIS B0601, B0651 or B0652.

It is further preferred that the toner receptor layer satisfies at least one, desirably tow or more, and more desirably all, of the following solid state properties (1) to (6):

(1) Melting temperature (Tm): Desirably higher than 30° C., but within +20° C. from a melting temperature of a toner (2) Temperature at which the toner receptor layer attains viscosity of $1\times10^5$ cp: Desirably higher than 40° C. but lower than that of toner (3) Elastic modulus (G) at a fixing temperature of the toner receptor layer: preferably in a range of from $1\times10^2$ to $1\times10^5$ Pa in terms of storage modulus (G') and in a range of from $1\times10^2$ to $1\times10^5$ Pa in terms of loss modulus (G")

(4) Loss tangent (G"/G') at a fixing temperature of the toner receptor layer which refers to a ration of the loss modulus (G") relative to the storage modulus (G'): preferably in a range of from 0.01~10

(5) Storage modulus (G') at a fixing temperature of the toner receptor layer with respect to storage modulus (G') at a fixing temperature of toner: preferably in a range of from −50 Pa to +2500 Pa from the storage modulus (G') at a fixing temperature of toner (6) Angle of inclination of molten toner on the toner receptor layer: preferably less than 50° and more desirably less than 40°.

Further, it is preferred that the toner receptor layer satisfies the solid state properties disclosed in, for example, Japanese Patent Publication 2788358, Unexamined Japanese Patent Publication Nos. 7-248637, 8-305067 and 10-23889.

It is preferred for the toner receptor layer to have a surface electrical resistance desirably in a range of from $1\times10^6$ to $1\times10^{15}$ Ω/cm$^2$ at a temperature of 25° C. under a relative humidity of 65%. If the lower surface electrical resistance of $1\times10^6$ Ω/cm$^2$ is exceeded, this indicates that an insufficient amount of toner is transferred to the toner receptor layer, then a toner image is apt to diminish in density. On the other hand, if the upper surface electrical resistance of $1\times10^{15}$ Ω/cm$^2$ is exceeded, electrostatic charges generating during image transfer is too much to transfer a sufficient amount of toner to the toner receptor layer so as thereby to lead to an insufficient density of toner image and generation of electrostatic that causes easy adhesion of dust to an elctrophotographic paper during handling the elctrophotographic paper. In addition, if the toner receptor layer that does not satisfy the requirement of surface electrical resistance causes the electrophotographic paper to be susceptible to misfeeding, double feeding, generation of discharge prints and an occurrence of fractional absence of toner transfer. In this instance, the surface electrical resistance can be found by measuring a surface electrical resistance of a sample at 20° C. under a relative humidity of 65% by the method meeting JIS K 6911 using a resistance meter, for example, Model R8340 (Advantest Co., Ltd.) after a lapse of one minute from impression of a voltage of 100V on the sample subsequently to controlling damp under the same temperature and humidity condition for 8 hours.

As was previously mentioned, the electrophotographic paper may be provided with other layers such as, for example, a surface protective layer, a backing layer, an adhesiveness improving layer, an intermediate layer, an under cast coating layer, a cushioning layer, an electrostatic charge control (antistatic) layer, a reflection layer, a color tincture adjusting layer, a storage stability improving layer, an anti-adhesion layer, an anti-curling layer, a smoothing layer, etc. These layers may be provided individually or in any combination of two or more.

The surface protective layer is formed on a surface of the electrophotographic paper for the purpose of surface protection, improvement of storage stability, handling adaptability and pass-through ability to pass through ectrophotographic equipments, creation of writing adaptability and anti-offset ability. The protection layer may be single-layered or multi-layered. Although various types of thermoplastic resin binders or thermosetting resin binders can be blended in the surface protective layer, it is preferred to use the same type of binder resin as used in the toner receptor layer. However, in this instance, the binder resin of the surface protective layer is not always necessarily the same in dynamic and electrostatic characteristics as those of the binder resin of the toner receptor layer and can be optimized in dynamic and electrostatic characteristics appropriately. The surface protective layer may be further blended with various additives that are allowed to be blended in the toner receptor layer such as, in particular, a matting agent or the like together with the releasing agent used in the electrophotographic paper previously described. The matting agent may be selected from those conventionally known in the art. It is preferred for an outermost surface layer (e.g. a surface protective layer when it is formed) of the electrophotoelectric paper to have better compatibility with a toner in light of fixing performance. Specifically, it is preferred for the outermost surface layer to have a contact angle with a molten toner in a range from 0 to 40°.

The backing layer is formed preferably on a surface opposite to the toner receptor layer of the base paper base support for the purpose of creation of back surface recording adaptability and improvement of back surface recording quality, curling balance and transport quality of the electrophotographic paper. Though the backing layer is not always bound by color, it is preferred for the backing layer to be white in the case where the electrophotographic paper is of two-sided. The backing layer has a whiteness and a spectral reflecting coefficient both higher than 85% similarly to the front surface. In order to improve both-side recording adaptability, the backing layer may be the same in structure as that on the toner receptor layer. Further, the backing layer may be blended with the various additives described above, appropriately such as a matting agent and an electrostatic charge control agent. In the case of using a roll lubricant oil for fixing rolls in order to prevent an occurrence of offset during fixation, the backing layer may be of an oleophic type. The backing layer may be single-layered or multi-layered inasmuch as having a thickness in a desirable range from 0.1 to 10 μm under normal conditions.

The electrophotogreaphic paper is preferably provided with an adhesiveness improving layer for the purpose of improving adhesiveness between the toner receptor layer and the base paper base support. The adhesiveness improving layer may be blended with various additives previously described, preferably a cross-linking agents. In order for the electrophotogreaphic paper to improve toner acceptability, it is preferred to provide a cushioning layer between the adhesiveness improving layer and the toner receptor layer.

The electrophotogreaphic paper may be provided with an intermediate layer between the paper base support and the adhesiveness improving layer, between the adhesiveness improving layer and the cushioning layer, between the cushioning layer and the toner receptor layer, or between the toner receptor layer and the storage stability improving layer.

The electrophotographic paper has a thickness preferably between, but not limited to, 50 and 550 μm and more preferably between 100 and 350 μm.

In the use of the electrophotographic paper for recording or copying, a toner is accepted to the toner receptor layer. The toner consists of at least a binding resin and a coloring agent, and, if needed, a releasing agent and other components.

Examples of the binding resin include, but not limited to, those most commonly used for toners, preferably styrene such as styrene, parachlorstyrene, etc.; vinyl ester such as vinyl naphthalene, vinyl chloride, vinyl bromide, vinyl fluoride, vinyl acetate, vinyl propionate, vinyl benzoate, vinyl butyrate, etc.; methylene aliphatic carboxylate ester such as methyl acrylate, ethyl acrylate, n-butyl acrylate, isobutyl acrylate, dodecyl acrylate, n-octyl acrylate, 2-chlorethyl acrylate, phenyl acrylate, methyl α-chloracrylate, methyl methacrylate, ethyl methacrylate, butyl methacrylate, etc; vinyl nitrile such as vinyl methyl ether, vinyl ethyl ether, vinyl isobutyl ether, etc; N-vinyl compounds such as N-vinyl pyrrole, N-vinyl carbazole, N-vinyl indole, N-vinyl pyrrolidone, etc.; homopolymers or copolymers of vinyl monomers of vinyl carbonate such as methacrylate, acrylic acids, cinnamic acids, etc.; and various types of polyester; which may be used in combination with various type of waxes. Among them, the same types of resins as used for the toner acceptor layer are especially preferred.

Examples of coloring agent include, but not limited to, those most commonly used for toners, preferably various pigments such as carbon black, chrome yellow, Hansa yellow, benzidine yellow, slen yellow, quinoline yellow, permanent orange GTR, pyrazolone orange, vulcan orange, watchung red, permanent red, brilliant cannine 3B, brilliant carmine 6B, deipon oil red, pyrazolone red, resole red, rhodamine B lake, lake red C, rose bengal, aniline blue, ultramarine blue, carco oil blue, methylene blue chloride, phthalocyanine blue, phthalocyanine green, malachite green oxalate, etc.; and various dye such as acridine dyes, xanthene dyes, azoic dyes, benzoquinone dyes, azine dyes, anthraquinone dyes, thioindigo dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazine dyes, thiazole dyes, xanthene dyes, etc. These pigments or dyes may be used individually or in any combination of two or more thereof. It is preferred for the toner to contain the coloring agent desirably in a range from 2 to 8% by mass. If the content of coloring agent is less than 2% by mass, the toner is apt to lose tinctorial power and, if it is beyond 8% by mass, the toner diminishes transparency.

Examples of releasing agent include, but not limited to, those most commonly used for toners, preferably higher crystalline polyethylene waxes with a comparatively low molecular weight, Fischer-Tropsch waxes, amide waxes, polar waxes containing nitrogen such as a compound having an urethane bond. It is preferred for the polyethylene waxes to have molecular weights desirably less than 1000, and more desirably in a range from 300 to 1000. The urethane compound (compound having urethane bonds) is especially preferred because it keeps itself in a solid state due to coagulation power of its polar group even though it has only a small molecular weight and can have a melting temperature set higher with respect to a low molecular weight. A preferable range of molecular weight is from 300 to 1000. While examples of the raw material for the compound include a combination of a diisocyanate compound and monoalcohol, a combination of monoisocyanate and monoalcohol, a combination of dialcohol and monoisocyanate, a combination of trialcohol and monoisocyanate, a combination of triisocyanate and monoalcohol, etc., it is preferred in order to keep the compound from having a high molecular weight to select combinations of a compound of multifunctional group and a compound of monofunctional group and is important for the compound to have quantitatively equivalent functional groups.

Example of monoisocyanate compounds include dodecyl isocyanate, phenyl isocyanate, derivatives of phenyl isocyanate, naphthyl isocyanate, hexyl isocyanate, benzyl isocyanate, butyl isocyanate, aryl isocyanate, etc. Example of diisocyanate compounds include tolylene diisocyanate, 4,4' diphenyl methane diisocyanate, toluene diisocyanate, 1,3-phenylene diisocyanate, hexamethylene diisocyanate, 4-methyl-m-phenylene diisocyanate, isophorone diisocyanate, etc. Examples of mono-alcohol include methanol, ethanol, propanol, butanol, pentanol, hexanol, heptanol, etc. Examples of dialcohol include various glycol such as ethylene glycol, diethylene glycol, triethylene glycol, trimethylene glycol, etc. Examples of trialcohol include trimethylolpropane, triethylolpropane, trimethanolethane, etc.

The respective urethane compounds may be mixed into a toner together with a resin and/or a coloring agent like ordinary releasing agents so as to furnish a pulverized mixed toner. When using the urethane compound as a releasing agent for a toner prepared through an emulsion polymerization-coagulation melting process, the urethane compound releasing agent is employed in the form of a particle dispersed liquid prepared by dispersing the urethane compound in water together with a polyelectrolyte such as an ionic surface-active agent, a polymer acid or a polymer base, heating it to a temperature higher than its melting point and then pulverizing it into particulates of less than 1 μm with strong shearing force by means of a homogenizer or a pressure discharge dispersing machine. The urethane compound particle dispersed liquid is be blended in the toner together with a resin particle dispersion liquid and/or a coloring agent particle dispersed liquid.

The toner may be blended with other components such as an internal additive, an electrostatic charge control agent, inorganic particulates, etc. Examples of the internal additive include various magnetic substances, namely: metals such as ferrite, magnetite, reduced iron, cobalt, nickel, manganese, etc.; alloys of these metals; compounds containing these metals; etc. Examples of the electrostatic charge control agent include dye comprising a quaternary ammonium salt compound, a nigrosin compound, a complex of aluminum, iron or chrome; and various triphenylmethane pigments; etc. which are ordinarily utilized as antistatic agent. In light of controlling ionic strength that affects stability of the toner during coagulation and melting and reducing wastewater pollution, it is preferred to employ electrostatic charge control agents that are hardly dissolved in water. Examples of the inorganic particulate include conventional additives that are know as external additives ordinarily applied to surfaces of toner particles such as silica, alumina, titania, calcium carbonate, magnesium carbonate, tricalcium phosphate, etc. It is preferred to use these inorganic particles in the form of a dispersion with an ionic surface-active agent, polymer acid or a polymer base.

Further, a surface-active agent may be additionally used for the purpose of emulsification polymerization, seed polymerization, dispersion of pigment, dispersion of resin particles, dispersion of a releasing agent, coagulation and stabilization of them. It is effective to use an anion surface-active agent such as sulfate salt surface-active agents, sulfonate surface-active agents, phosphate surface-active agents or soap surface-active agents or the like; a cationic surface-active agent such as amine salt surface-active agents or quaternary ammonium salt surface-active agents or the like; or a nonionic surface-active agent such as polyethylene glycol surface-active agents, surface-active agents added with an alkylphenol ethylene oxide, polyhydric alcohol surface-active agents or the like. It is possible to use popular dispersing machines such as a rotary shearing type of homogenizer, a ball mill using a shearing medium, a sand mill, a dyno mill or the like in order to prepare a dispersion of the surface-active agent.

An external additive may be further added to the toner as appropriate. Examples of the external additive include inorganic particles such as particles of $SiO_2$, $TiO_2$, $Al_2O_3$, CuO, ZnO, $SnO_2$, $Fe_2O_3$, MgO, BaO, CaO, $K_2O$, $NaO_2$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, or the like and organic particles such as powder of fatty acid, a derivative of fatty acid or metallic alts of them; powder of a fluorocarbon resin, a polyethylene resin, an acryl resin or the like. It is preferred for these particles to have an average particle size desirably in a range of from 0.01 to 5 μm, and more desirably in a range offrom 0.1 to 2 μm.

Although various methods may be used to produce the toner without any particular restriction, it is preferred to employ a method comprising the following processes (i) to (iii):

(i) A process of coagulating resin particles in a resin particle dispersion liquid so as thereby to prepare a coagulated resin particle dispersion liquid;

(ii) A process of mixing a dispersion liquid of particulates with the coagulated resin particle dispersion liquid to cause the particulates to adhere to the coagulated resin particles; and (iii) A process of heating and melting the particulate-adhered coagulated particles to form toner particles.

The volumetric average particle size of toner particles is preferably in a range of from 0.5 to 10 μm. If the volumetric average particle size is too small, it affects tractability of the toner (facility for replenishment, cleaning adaptability and flowability) and particle productivity. On the other hand, if the volumetric average particle size is too large, it affects image quality and resolution due to graininess and transferability. It is preferred for the toner satisfying the requirement of volumetric average particle size to have a distribution index of volumetric average particle size (GSDv) equal to or less than 1.3. It is further preferred for the toner to have a distribution ratio of volumetric average particle size distribution index relative to number average particle size distribution index (GSDv/GSDn) equal to or greater than 0.95. In addition, it is preferred for the toner satisfying the requirement of volumetric average particle size to have an average profile factor expressed by the following equation in a range from 1.00 to 1.50.

$$\text{Profile factor}=(\pi\times L^2)/(4\times S)$$

where L is representative of a greatest size of toner particles and S is representative of a projected area of toner particles.

When satisfying the requirements as set forth above, the toner has an positive effect on image quality, in particular graininess and resolution of an image, significantly reduces or prevents fractional absence of toner and/or blurred toner image occurring concurrent with toner image transfer, and is hardly apt to have an adverse effect on handling characteristics of the toner even though the toner has an average particle size not so small.

In this instance, it is preferred for the toner itself to have a storage modulus (G') (that is measured with an angular frequency of 10 rad/sec) at a temperature of 150° C. in a range from $1\times10^2$ to $1\times10^5$ Pa in light of improving image quality and offset resistance in a fixing process.

The heat-sensitive recording paper comprises, for example, at least a thermal color development layer formed as an image recording layer on the paper base support of the present invention and is suitably used with a thermo-autochrome method (AT method) by which an image is formed by repeating heating with a thermal head and fixation with ultraviolet radiation.

The sublimation transfer recording paper comprises, for example, at least an ink layer containing thermal diffusion dye (sublimation dye) formed as an image recording layer on the paper base support of the present invention and is suitably with a sublimation transfer method by which an image is formed by selectively heating the ink layer with a thermal head to transfer the thermal diffusion dye to the sublimation transfer recording paper from the ink layer.

The thermal transfer recording paper comprises, for example, at least a hot-melt ink layer formed as an image recording layer on the paper base support of the present invention and is suitably used with a melting transfer method by which an image is formed by selectively heating the hot-melt ink layer with a thermal head to transfer the molten ink to the thermal transfer recording paper.

The silver salt photographic paper comprises, for example, at least Y, M and C image forming layers formed as an image recording layer on the paper base support of the present invention and is suitably used with a silver salt photographic method by which an image is formed by performing color development, breaching and fixation, washing and drying while an exposed silver salt photographic paper travels through processing tanks.

The ink-jet recording paper comprises, for example, a color material receptive layer, that is capable of receiving a color material such as liquid inks, namely an aqueous ink (comprising dye or pigment as a color material) and an oil-based ink, and solid inks that are solid at a normal temperature and is melted and liquefied upon recording, formed as an image recording layer on the paper base support of the present invention.

The paper base support is suitably available for printing paper as well as for an image recording medium and, in this case, preferred to have a high mechanical strength in light of application of ink to the printing paper by a printing machine.

In the case where the base paper is used for the image recording medium, it is preferred for the base paper to contain a filler, a softening agent, internal auxiliary agents for papermaking, etc. Examples of the filler include generally available fillers, namely inorganic fillers such as clay, burnt clay, diatom earth, talc, kaolin, burnt kaolin, delami kaolin, calcium carbonate heavy, precipitated calcium carbonate light, magnesium carbonate, barium carbonate, titanium dioxides, zinc oxides, silicon dioxides, amorphous silica, aluminium hydroxides, calcium hydroxides, magnesium hydroxides, zinc hydroxides, etc. and organic fillers such as urea-formalin resins, polystyrene resins, phenol resins, hollow particulates, etc. These fillers may be used independently or in any combination of two or more thereof.

Examples of the internal auxiliary agent include nonionic or cationic yield ratio improvers, freeness improvers, paper strength improvers, internal sizing agents, which are conventionally used in the art. More specifically, there are a variety of internal auxiliaries, namely: basic aluminium compounds such as aluminum sulfate, aluminium chloride, soda aluminate, basic aluminium chloride, basic aluminium polyhydrated, etc.; polyvalent metal compounds such as ferrous sulfate, ferric sulfate, etc.; water-soluble polymers such as starch, processed starch, polyacrylamide, urea resins, melamine resins, epoxy resins, polyamide resins, polyamine resins, polyamine, polyethylene imine, vegetable gum, polyvinyl alcohol, latex, polyethylene oxides, etc., disperses of hydrophilic cross-linked polymer particles, derivatives or denatured products of them; and the like. The respective substances have some functions of internal auxiliary agents for papermaking concurrently.

Examples of the internal sizing agent include alkylketene dimer compounds, alkenylsucinic anhydride compounds, styrene-acryl compounds, higher fatty acid compounds, petroleum resin sizing agents and rosin sizing agents.

The paper base support may further contain one or more internal additives for papermaking such as dye, a fluorescent brightening agent, a pH adjuster, a defoaming agent, a pitch controller, a slime controller, etc., as appropriate.

The printing paper described above is suitably used especially in offset lithography, and available as relief printing paper, photogravure printing paper and electrophotophotographic printing paper.

As described above, because the image recording medium of the present invention comprises a paper base support for image recording medium striking a balance between high smoothness and fine stiffness on a high level and an image recording layer formed on the paper base support, the image recording medium can record high quality images thereon and create fine glossiness and high smoothness, so as to be suitably used as a variety of image recording papers including an electrophotographic recording paper, a heat-sensitive recording paper, a sublimation transfer recording paper, a thermal transfer recording paper, a silver salt photographic paper and an ink-jet recording paper.

EXAMPLE

The following description will be directed to examples of the paper base support and the image recording paper of the present invention.

Practical Example I

Abase paper was prepared in the following manner. Pulp having a fiber length of 0.65 mm was prepared by beating bleached broad leaf tree kraft pulp (LBKP) to a freeness of 340 ml in Canadian Standard Freeness (C.S.F.) by the use of a conical refiner. A pulp stock was prepared by adding 1.5 parts by mass of cation starch, 0.4 parts by mass of alkylketene dimer (AKD) as a sizing agent, 0.1 part by mass of styrene acrylic emulsion, 0.3 parts by mass of polyamide polyamine epichlorohydrin, 0.2 parts by mass of anion polyacrylamide, 0.1 part by mass of colloidal silica in this order to 100 parts by mass of the pulp. The part of alkyl of the alkylketene dimer is derived from a fatty acid primarily composed of behenic acid. Thereafter, 150 g/m$^2$ of base paper was made from the paper stock by the use of a fourdrinier paper machine. A surface sizing agent consisting of 2 g/m$^2$ of oxidized starch and 0.9 g/m$^2$ of sodium chloride was made adhered to the top side surface (the surface for image formation) of the base paper by the use of a size press machine in a drying zone of the a fourdrinier paper machine. In the end of the fourdrinier paper machine, calendering was applied to the base paper so as to adjust the paper density to 0.98 g/m$^3$. The carendering was performed keeping a surface temperature of the metal roll for the top side surface of the base paper at 120° C. and a surface temperature of the plastic roll for the wire side surface of the base paper at 50° C. The finished base paper had a degree of sizing of 24.5 g/m$^2$ at the top side and a degree of sizing of 25.8 g/m$^2$ at the wire side in Cobb$_{120}$ value measured by the method meeting JIS P8140. The base paper was further coated with a coating liquid so as to form a cast coating layer having a spread of 20 g/m$^2$ on the top side surface. The coating liquid had a composition specified below.

| | |
|---|---|
| Clay/Styrene acryl hollow micro particles: | 70/30 parts by mass |
| Sodium polyphosphate: | 0.5 parts by mass |
| Casein: | 8 parts by mass |
| MBR latex (Nalster MR-170; Nippon A & L Inc.): | 16 parts by mass |
| Polyethylene/Wax emulsion (melting point: 79° C.): | 6 parts by mass |
| Ammonium zirconium carbonate | 3 parts by mass |
| Tributyl phosphate | 0.5 parts by mass |
| Turkey red oil | 1 part by mass |

Subsequently, after having treated the top side surface of the base paper with corona discharge, a paper base support of practical example I (PE I) was prepared by forming 28 μm thick of polyethylene coating layer on the top side surface of the base paper by extrusion of a low density polyethylene containing 10% by mass of a titanium oxide and 19 μm thick of polyethylene coating layer on the wire side surface of the base paper by extrusion of a polyethylene composition consisting of 3 parts of low density polyethylene and 7 parts of high density polyethylene. Further, gelatin was applied over the top side polyethylene coating layer to as to form an under coating layer having a spread of 0.1 μm$^2$, so as thereby to complete the paper base support of practical example I (PE I).

Practical Example II

A paper base support of practical example II (PE II) for the image recording paper was prepared in the same manner as the paper base support of practical example I (PE I) except that 0.15 parts by mass of epoxidized fatty acid amide (EFA) and polyvinyl alcohol (PVA) were used as a sizing agent to be added in a pulp stock and a surface sizing agent to be attached to the base paper, respectively in place of 0.4 parts by mass of alkylketene dimer (AKD) and the oxidized starch used in the paper base support of practical example I (PE I), respectively.

Practical Example III

A paper base support of practical example III (PE III) for the image recording paper was prepared in the same manner as the paper base support of practical example I (PE I) except for 0.25 parts by mass of alkylketene dimer (AKD) as a sizing agent to be added in a pulp stock, higher fatty acid calcium in pace of the polyethylene wax as a water repellent agent that is one of the constituents of the coating liquid, and polypropylene for the polymer coating later.

Practical Example IV

A paper base support of practical example IV (PE IV) for the image recording paper was prepared in the same manner as the paper base support of practical example I except that the base paper and coating conditions of the coating layer were changed as shown in Table II.

Practical Example V

A paper base support of practical example V (PE V) for the image recording paper was prepared in the same manner as the paper base support of practical example I except that the base paper and coating conditions of the coating layer were changed as shown in Table II.

Comparative Example II

A paper base support of comparative example II (CE II) for the image recording paper was prepared in the same manner as the paper base support of practical example I except that the base paper and coating conditions of the coating layer were changed as shown in Table II.

Comparative Example III

A paper base support of comparative example II (CE III) for the image recording paper was prepared in the same manner as the paper base support of practical example I except that the base paper and coating conditions of the coating layer and the polymer coating layer were changed as shown in Table II.

Comparative Example III

A paper base support of comparative example III (CE III) for the image recording paper was prepared in the same manner as the paper base support of practical example I except that the base paper and coating conditions of the coating layer and the polymer coating layer were changed as shown in Table II.

Comparative Example IV

A paper base support of comparative example IV (CE IV) for the image recording paper was prepared in the same manner as the paper base support of practical example I except for omission of the coating layer.

Comparative Example V

A paper base support of comparative example V (CE IV) for the image recording paper was prepared in the same manner as the paper base support of practical example I except for omission of the polymer coating layer.

TABLE II

| | Base paper | | | Coating layer | | | Polymer coating-layer |
|---|---|---|---|---|---|---|---|
| | Sizing agent | | Surface | Water | | | |
| | Type | Quantity (mass %) | sizing-agent | repel-lent | Water resisting agents, | Drying | Resin Top/Wire |
| PE I | AKD | 0.4 | Oxidized starch | PEW | AZC | Cast | PE/PE |
| PE II | EFA | 0.15 | PVA | PEW | AZC | Cast | PE/PE |
| PE III | AKD | 0.25 | PVA | FAC | AZC | Cast | PP/PP |
| PE IV | EFA | 0.6 | Synthetic wax | PEW | UFA | Cast | PE/PE |
| PE V | ASA | 0.6 | PVA | FAC | UFA | Hot air | PP/PP |
| CE I | Rosin | 0.6 | Oxidized starch | PEW | — | Hot air | PE/PE |
| CE II | EFA | 0.15 | PVA | — | — | Hot air | PP/PP |
| CE III | — | — | — | — | AZC | Hot air | PP/PP |
| CE IV | AKD | 0.4 | Oxidized starch | | No coating layer | | PE/PE |
| CE V | Rosin | 0.6 | Oxidized starch | — | — | Hot air | — |

*AKD: Alkylketene dimers (sizing agent)
*EFT: Epoxidized fatty acid amide (sizing agent)
*PVA: Polyvinyl alcohol (surface sizing agent)
*PEW: Polyethylene wax
*AZC: Ammonium zirconium carbonate
*FAC: Higher fatty acid calcium
*UEA: Urea formaldehyde
*PE: Polyethylene
*PP: Polypropylene The paper base supports of the respective examples PE I~PE V and CE I~PEI V were assessed on smoothness according to water absorbence in terms of cross section water absorption quantity measured in the following manner and the result is shown together with the degrees of sizing in $Cobb_{120}$ value measured by the method meeting JIS P8140 in Table III.

The water absorption quantity of cross section was measured on 10×1.5 cm sample of the paper base support after wiping off attached water immediately after five minutes immersion in a water bath at 20° C. As was disclosed previously, the water absorption quantity of cross section is given by the following expression.

$$\text{Water absorption quantity of cross section (mg)}=A-B$$

where A is the mass of paper base support after immersion and B is the mass of paper base support before immersion.

The paper base supports of the respective examples were assessed on surface smoothness based on center line mean surface roughness (SRa) of their top side surfaces (the surfaces for image formation) measured under the following conditions using a surface shape measuring device, SURFCOM, Model 570A-3DF (Tokyo Seimitsu Co., Ltd.) under the following conditions.

| | |
|---|---|
| Conditions: | |
| Scanning direction: | Machine direction (MD) of the sample |
| Measuring length: | |
| X direction (papermaking direction): | 50 mm |
| Y direction (direction perpendicular to X direction): | 30 mm |
| Measuring pitch: | |
| X direction: | 0.1 mm |
| Y direction: | 0.1 mm |
| Scanning speed: | 30 mm/sec |

-continued

| | |
|---|---|
| Measuring pitch: | |
| X direction: | 0.1 mm |
| Y direction: | 0.1 mm |
| Band pass filter: | 5~6 mm |

The electrophotographic paper of each example was rated according to the following grades by visually examination and the result is shown in Table III.

Assessment grade for smoothness

A: Very excellent (SRa is less than 0.3 μm)

B: Excellent (SRa is less than 0.5 μm)

C: Average (SRa is between 0.5 and 1.0 μm)

D: Poor (SRa is between 1.0 and 2.0 μm)

E: Very poor (SRa is greater than 0.3 μm)

TABLE III

| | Degree of sizing in $Cobb_{120}$ value of base paper ($g/m^2$) | | Support for image recording medium | |
|---|---|---|---|---|
| | Top side | Wire side | water absorption quantity of cross section (mg) | Smoothness |
| PE I | 24.5 | 25.8 | 7 | A |
| PE II | 36.1 | 37.9 | 17 | A |
| PE III | 30.5 | 39.8 | 13 | A |
| PE IV | 7.8 | 6.9 | 3 | A |
| PE V | 19.5 | 20.3 | 8 | B |
| CE I | 44.6 | 44.5 | 30 | C |
| CE II | 36.1 | 37.9 | 25 | B |
| CE III | 77.8 | 75.9 | 56 | C |
| CE IV | 24.5 | 25.8 | 6 | D |
| CE V | 44.6 | 44.5 | — | E |

Practical Examples VI~X and Comparative Examples VI~X

In order to assess image quality, glossiness and water resisting property, electrophtographic papers of practical examples VI~X (PE VI~PE X) and comparative examples VI~X (CE VI~CE X) were made from the paper base supports of the practical examples I~V and comparative examples I~V, respectively, in the following manner.

First of all, a titanium dioxide dispersion liquid was prepared by mixing 40.0 g of titanium dioxide, Taipek A-220 (Ishihara-sangyo Ltd.), 2.0 g of polyvinyl alcohol, PVA102 (Kurare Co., Ltd.) and 58.0 g of ion-exchange water together and preparing a dispersing the mixture so as to contain 40% by mass of the titanium dioxide using a dispersion machine, Model NBK-2 (Nihon Seiki Co., Ltd.). Thereafter, a coating liquid for the toner receptor layer was prepared by mixing 15.5 g of the titanium dioxide dispersion liquid; 15.0 g of dispersion liquid of carnauba wax, Serozole 524 (Chukyo Oils & Fats Co., Ltd.); 100.0 g of water dispersion of a polyester resin, KAZ-7049 (Unitika Ltd), having a solid content of 30% by mass; 2.0 g of a viscosity improver, Alcox (Meisei Chemical); 0.5 g of an anion surface active agent (AOT); and 80 ml of ion-exchange water. Viscosity and surface tension of the coating liquid were adjusted to 40 mPa·s and 34 mN/m, respectively.

Separately, a coating liquid for the backing layer was prepared by mixing 100 g of water dispersion of an acrylic resin, Hyros XBH-997L (Seiko Chemical Industry Co., Ltd.), having a solid content of 30% by mass); 5.0 g of a matting agent, Tecpolymer MBX-12 (Sekisui Chemical Co., Ltd.); 10.0 g of a releasing agent, Hydrin D337 (Chukyo Oils & Fats Co., Ltd.); 2.0 g of a viscosity improver (CMC); 0.5 g of an anion surface active agent (AOT); and 80 ml of ion-exchange water. Viscosity and surface tension of the coating liquid was adjusted to 35 mPa·s and 33 mN/m, respectively.

A toner receptor layer and a backing layer were formed on the top and wire surfaces of the paper base support of each example, respectively, by coating the coating liquids prepared as above, respectively, using a bar coater so that the toner receptor layer and a backing layer had dry mass of 12 g/m and 9 g/m$^2$, respectively. In the instance, the toner receptor layer had a pigment content of 5% by mass with respect to the thermoplastic resin content. Subsequently the toner receptor layer and the backing layer were dried by an online hot air blower. The amount and temperature of hot air flow were adjusted so that these layers were dried out within two minutes. The dry point was set to so that a surface temperature of the coated layer became equal to a wet-bulb temperature of the hot-air. After drying, the paper base support was further calendered using a gloss calender machine a metal roll kept at a surface temperature of 40° C. under a nip pressure of 14.7 kN/m$^2$ (15 kgf/cm$^2$) so as thereby to complete a sample electrophotographic paper.

Figure 4:
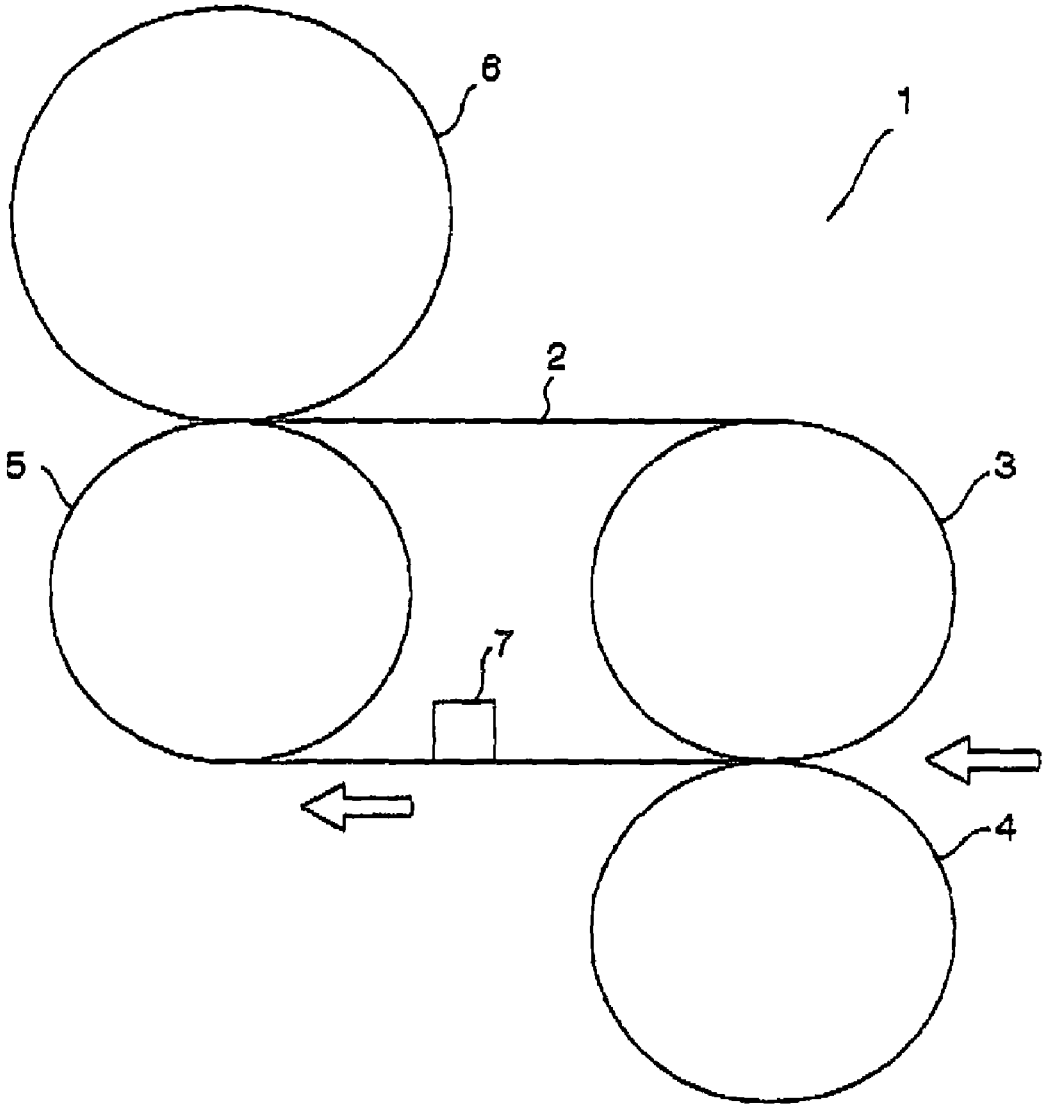
FIG. 4 is a schematic constitutional view of a belt fixing device of a printer.

The electrophotographic paper of each example cut to an A-4 size was put into print to record an image thereon using a laser color printer, Model DocuColor 1250-PF (Fuji Xerox Co., Ltd) additionally equipped with a belt fixing device 1 shown in FIG. 4.

As shown in FIG. 6, the belt fixing device 1 comprises a fixing belt 2 mounted between a heating roll 3 and a tension roll 5 and a cooling device 7 disposed between the heating roll 3 and the tension roll 5. The belt fixing device 1 further comprises a pressure roll 4 disposed adjacent to the heating roll 3 so as to press the fixing belt 2 against the heating roll 3 and a cleaning roll 6 disposed adjacent to the tension roll 5 so as to keep in contact with the fixing belt 2. The electrophotographic paper with a latent toner image formed thereon is fed into a nip between the heating roll 3 and the pressure roll 4 from the right side in the figure and moved by the fixing belt 2 for fixation. During the movement, the electrophotographic paper is cooled by the cooling device 7 and cleaned by the cleaning roll 6. The belt fixing device 1 was operated to move the fixing belt 2 at a belt speed of 30 mm/sec. A nip pressure between the heating roll 3 and the pressure roll 4 was set to 0.2 MPa (2 kgf/m$^2$). Further, the heating roll 3 was kept at 150° C. for a fixing temperature, and the pressure roll 4 was kept at 120° C.

The print images formed on the electrophotographic paper of each example were comparatively examined on image quality and glossiness and rated according to the following grades by visual observation, and the result is shown in Table IV Assessment grade for image quality and glossiness A: Very excellent (acceptable as a high quality recording paper)

B: Excellent (acceptable as a high quality recording paper)

C: Average (unacceptable as a high quality recording paper)

D: Poor (unacceptable as a high quality recording paper)

E: Very poor (unacceptable as a high quality recording paper)

Further, the electrophotographic paper of each example cut to an A-4 size and prints made from the electrophotographic paper were comparatively examined on water resisting property by visually observing edge penetration, edge undulations and/or edge blisters, ply separation and coating separation of the electrophotographic paper after 30 minutes immersion in a water bath at 20° C. and rated according to the following grades, and the result is shown in Table IV.

TABLE IV

| | | Image | Glossi- | Water resisting property | |
|---|---|---|---|---|---|
| | Support | quality | ness | Paper | Print |
| PE VI | PE I | A | A | A | A |
| FE VII | PE II | B | A | B | A |
| PE IIX | PE III | A | A | A | A |
| PE IX | PE IV | A | A | A | A |
| PE X | PE V | B | B | A | A |
| CE VI | CE I | C | C | D | D |
| CE VII | CE II | B | C | D | C |
| CE IIX | CE III | C | C | E | E |
| CE IX | CE IV | D | E | A | A |
| CE X | CE V | E | E | E | E |

As described in detail above, the paper base support of the present invention, and hence the image recording medium comprising the paper base support of the present invention, has high smoothness and fine glossiness sufficiently enough for various types of image recording mediums including electrophotographic paper, heat sensitive printing paper, ink-jet printing paper, sublimation transfer printing paper, silver salt photographic printing paper, thermal transfer printing paper and the like.

It is to be understood that although the present invention has been described with regard to a preferred embodiments thereof, various other embodiments and variants may occur to those skilled in the art, which are within the scope and spirit of the invention, and such other embodiments and variants are intended to be covered by the following claims.

What is claimed is:

1. A paper base support for an image recording medium comprising:

base paper;

a polymer coating layer formed on each of a top surface and a wire side surface of said base paper; and a coating layer containing a pigment, an adhesive agent, a water resisting agent and a water repellent additive which is formed under said polymer coating layer on at least one of said top surface and said wire side surface;

wherein said water resisting agent is selected from the group consisting of ethylene-vinyl acetate copolymers, vinylidene chloride copolymers, ammonium zirconium carbonate, melamine-formaldehyde resins, ketone-aldehyde resins, and aldehyde starches; and wherein said paper base support has a water absorbance less than 20 mg in terms of water absorption quantity of cross section (mg) given by the following expression:

$$\text{water absorption quantity of cross section (mg)} = A - B$$

where A is the mass of a 10×1.5 cm paper base support after wiping off attached water after five minute immersion in a water bath at 20° C. and B is the mass of the paper base support before immersion.

2. The paper base support defined in claim 1, wherein said paper base support has a degree of sizing in a range of from 5 to 35 g/m$^2$ in $\text{Cobb}_{120}$ value measured by the method meeting JIS P8140.

3. The paper base support as defined in claim 1, wherein said paper base support contains a sizing agent whose content is greater than 0.1% by mass.

4. The paper base support as defined in claim 3, wherein said sizing agent is one selected from a group consisting of alkylketene dimers, epoxidized fatty acid amide, alkenyl anhydrate succinic acids and higher fatty acid salts.

5. The paper base support as defined in claim 1, wherein said coating layer comprises a cast coating layer.

6. The paper base support as defined in claim 1, wherein said polymer coating layer contains a polyolefin resin.

7. An image recording medium comprising a paper base support as defined in claim 1 and an image recording layer formed on said paper base support.

8. The image recording medium as defined in claim 7, wherein said image recording medium is one selected from a group of an electrophotographic image recording medium, a heat sensitive recording medium, a sublimation transfer recording medium, a thermal transfer recording medium, a silver halide photographic recording medium and an ink-jet recording medium.

* * * * *